US010994971B2

(12) United States Patent
Van Den Broek et al.

(10) Patent No.: US 10,994,971 B2
(45) Date of Patent: May 4, 2021

(54) CRANE, METHOD FOR ASSEMBLING A CRANE AND METHOD FOR DISASSEMBLING A CRANE

(71) Applicant: Sucof, B.V., Utrecht (NL)

(72) Inventors: Anton Adrian Joachim Van Den Broek, Rijen (NL); Wessel Helmens, Stolwijk (NL); Pieter Maria Stoof, Breda (NL)

(73) Assignee: Mammoet Engineering B.V., Schiedam (NL)

( * ) Notice: Subject to any disclaimer, the term of this patent is extended or adjusted under 35 U.S.C. 154(b) by 10 days.

(21) Appl. No.: 16/607,275

(22) PCT Filed: Apr. 24, 2018

(86) PCT No.: PCT/NL2018/050262
§ 371 (c)(1),
(2) Date: Oct. 22, 2019

(87) PCT Pub. No.: WO2018/199750
PCT Pub. Date: Nov. 1, 2018

(65) Prior Publication Data

US 2020/0299111 A1 Sep. 24, 2020

Related U.S. Application Data

(60) Provisional application No. 62/490,221, filed on Apr. 26, 2017.

(30) Foreign Application Priority Data

Apr. 26, 2017 (NL) ..... NL2018785
Sep. 8, 2017 (NL) ..... NL2019512

(51) Int. Cl.
*B66C 23/36* (2006.01)
*B66C 23/70* (2006.01)
*B66C 23/00* (2006.01)

(52) U.S. Cl.
CPC ..... *B66C 23/365* (2013.01); *B66C 23/54* (2013.01); *B66C 23/70* (2013.01); *B66C 2700/0357* (2013.01)

(58) Field of Classification Search
CPC ..... B66C 23/26; B66C 23/34; B66C 23/344; B66C 23/36; B66C 23/365; B66C 23/54;
(Continued)

(56) References Cited

U.S. PATENT DOCUMENTS

2015/0291401 A1 10/2015 Orfey et al.
2018/0065833 A1* 3/2018 Stoof ..... B66C 23/74

FOREIGN PATENT DOCUMENTS

WO 2016133389 A2 8/2016

OTHER PUBLICATIONS

Int'l Search Report and Written Opinion in copending PCT Application No. PCT/NL2018/050262 dated Jul. 2, 2018, 2 pages.
(Continued)

*Primary Examiner* — Michael R Mansen
*Assistant Examiner* — Juan J Campos, Jr.
(74) *Attorney, Agent, or Firm* — Blank Rome LLP

(57) ABSTRACT

A crane, a method for assembly of a crane and a method for disassembly of a crane are disclosed. In accordance with the method, a first mast is fixed in a vertical position. A top mast section of a second mast is positioned adjacent to and outside of the first mast. The top mast section is moved vertically upwards, and this movement is guided by a guide system. Then, the top mast section is fixed relative to the first mast at a position which is at a larger vertical distance from the crane base. Then, a first intermediate mast section of the
(Continued)

second mast is fixed to a lower end of the top mast section to build up the second mast. Then, the first intermediate mast section is connected to a pivot, and the second mast is pivoted away from the first mast.

20 Claims, 26 Drawing Sheets

(58) Field of Classification Search
CPC ..... B66C 23/62; B66C 23/64; B66C 23/70; B66C 23/82
See application file for complete search history.

(56) References Cited

OTHER PUBLICATIONS

Search Report and Written Opinion in copending NL Application No. 2018785 dated Feb. 6, 2018, 10 pages.

* cited by examiner 300
301
312
313
314
311
311a
311b
201
201a
201b
204
204a
204b
204c
320
200
241

CRANE, METHOD FOR ASSEMBLING A CRANE AND METHOD FOR DISASSEMBLING A CRANE

FIELD OF THE DISCLOSURE

The invention pertains to the field of hoisting cranes and hoisting devices, in particular large cranes of modular design wherein the crane is transported in disassembled condition to a site where a hoisting job is to be performed and then assembled.

BACKGROUND OF THE DISCLOSURE

In the field, large lattice boom cranes are used which are assembled on the site at which they are to be operated. Usually, the main boom and/or the back mast of the crane are assembled whilst lying on the ground, and then hoisted and/or pulled up into their operating position. A quite common problem is that limited space is available at the site to build up the crane, e.g. when a new reactor vessel is to be installed at an existing petrochemical plant.

Several solutions to this problem have been proposed.

For example, WO2014/140723 proposes a telescopic arrangement for building a jacking tower. A scissors-like mechanism jacks up mast sections of the mast, thereby creating room at the bottom of the tower for the addition of a subsequent mast section. The vertical movement of the assembled subsections is guided by lower, wider guides mast sections of the tower which extend around the subsections at the lower part of the tower.

The system and method according to WO2014/140723 can however not be used for the assembly of cranes which have masts that are pivotable about a horizontal pivot axis.

WO2016/133389 proposes a method in which first a full length vertical ballast mast is assembled on site by stacking subsequent mast sections on top of each other. Then, a back mast is assembled by connecting a top mast section of the back mast to the ballast mast, and making this top mast section climb up the ballast mast while adding mast sections of the ballast mast from below. After the back mast has been fully assembled, the main boom is constructed by stacking mast sections on top of each other.

The method of WO2016/133389 still requires working at significant heights, which can be impractical, in particular in confined spaces. Furthermore, it requires the presence of a full length ballast mast, which is not always desirable.

SUMMARY OF THE DISCLOSURE

It is the object of the invention to provide a crane which is suitable for assembly and disassembly at a site where limited space is available. Furthermore, the object of the invention is to provide a practical method for assembling and for disassembling such a crane.

The object of the invention is obtained by a crane, which comprises:

- a crane base,
- a first mast, which is pivotable about a first pivot which is arranged at the crane base, the first pivot having a horizontal pivot axis, which first mast has a longitudinal axis, which first mast comprises a plurality of mast sections, wherein the first mast is one of the back mast and the main boom,
- a second mast, which is pivotable about a second pivot which is arranged at the crane base, the second pivot having a horizontal pivot axis, which second mast has a longitudinal axis, which second mast comprises a plurality of mast sections, wherein the second mast is the other one of the back mast and the main boom,
- a first mast fixing device, which is adapted to releasably fix the first mast in a vertical position relative to the crane base,
- a guide system, which comprises a first guide device connected to an exterior surface of the first mast and a second guide device which is connected to an exterior surface of the second mast, wherein the guide system has a connected state in which the longitudinal axis of the first mast and the longitudinal axis of the second mast both extend vertically and parallel to each other, and in which connected state the first guide device and the second guide device are movably connected to each other, the guide system being adapted to guide relative movement in vertical direction of at least a mast section of the second mast which is connected to the second guide device and at least a mast section of the first mast which is connected to the first guide device, and wherein the guide system further has a disconnected state in which the first guide device and the second guide device are disconnected from each other,

- a mast section mounting device, which is adapted to—during assembly of the crane—move at least a mast section of the second mast which is connected to the guide system vertically upwards relative to at least a mast section of the first mast while the guide system is in the connected state,
- a mast section locking device, which is adapted to lock at least a mast section of the second mast in a fixed position relative to at least a mast section of the first mast when the guide system is in the connected state,
- a mast pivot actuator, which is adapted to pivot the first mast and the second mast away from each other when the guide system is in the disconnected state.

The crane base can for example be the chassis of a crawler crane, and/or a foot assembly of a ringer crane. The crane base may for example comprise rollers and/or slide shoes. Optionally, the crane base can absorb both pushing forces and pulling forces from the masts of the crane.

Optionally, the crane base comprises multiple outriggers, e.g. three or more outriggers, optionally at least eight outriggers. The outriggers are arranged at a distance (at least in horizontal direction) from the lower ends of the masts. In a possible variant, the horizontal distance from at least one outrigger to the center of a mast is more than 1.5 times the width of the mast.

The crane base is arranged on a support surface of the working area. The support surface is for example a part of the ground which is provided with loose steel plates for better consistency.

The first mast is either a back mast or a main boom. The first mast is pivotable about a first pivot which is arranged at the crane base. This first pivot has a horizontal pivot axis. The first mast comprises a plurality of mast sections. Optionally each mast section is individually assembled on site at the working location from separate tubes and/or beams, which are for example connected to each other by pin-hole connections. The first mast has a longitudinal axis, which extends in the direction of the length of the mast.

Optionally, the first mast is a lattice mast. Optionally, the first mast has an A-shape or a Y-shape.

The second mast is the other one of a back mast and a main boom. So, if the first mast is a back mast, then the second mast is the main boom. If the first mast is a main boom, then the second mast is the back mast.

The second mast is pivotable about a second pivot which is arranged at the crane base. This second pivot has a horizontal pivot axis. The second mast comprises a plurality of mast sections. Optionally each mast section is individually assembled on site at the working location from separate tubes and/or beams, which are for example connected to each other by pin-hole connections. The second mast has a longitudinal axis, which extends in the direction of the length of the mast.

Optionally, the second mast is a lattice mast. Optionally, the second mast has an A-shape or a Y-shape.

In a possible embodiment, the horizontal pivot axis of the first pivot is parallel to the horizontal pivot axis of the second pivot. Optionally, the horizontal pivot axis of the first pivot and the horizontal pivot axis of the second pivot are coaxially with each other.

In a possible embodiment, the first pivot and the second pivot are spaced apart from each other. This may be advantageous in view of the size of the masts, and in addition it helps to reduce the local ground pressure under the crane base.

Optionally, the first pivot and the second pivot may coincide with each other. In that case, the crane for example comprises a combined pivot which is arranged at the crane base. The first and the second mast are in this embodiment both pivotable about the combined pivot. The combined pivot has a horizontal pivot axis.

The crane according to the invention further comprises a first mast fixing device. The first mast fixing device is adapted to releasably fix the first mast in a vertical position relative to the crane base during at least a part of the assembly and/or disassembly of the crane. So, the first mast fixing device is adapted to temporarily fix the first mast in a vertical position, and to release this fixing when it is no longer required. The first mast fixing device for example fixes the mast to the crane base and/or to one or more strong points in the vicinity of the crane, e.g. to a solid and heavy structure such as a rock mass or a heavy reactor vessel.

"Vertical" means extending at 90° relative to the horizontal, and includes small unintended and/or small undeliberate deviations therefrom. In general, the deviation from the pure vertical direction will not be more than about 5°.

The crane according to the invention further comprises a guide system. The guide system comprises a first guide device which is connected to an exterior surface of the first mast and a second guide device which is connected to an exterior surface of the second mast. An exterior surface is a face of the mast which faces outward. In masts which contain a single boom, the exterior surface faces away from the longitudinal center line of that boom.

The guide system has a connected state and a disconnected state. In the connected state, the longitudinal axis of the first mast and the longitudinal axis of the second mast both extend vertically and parallel to each other. Small unintended and/or undeliberate deviations may occur. In the connected state, the first guide device and the second guide device are movably connected to each other. The guide system is adapted to guide relative movement in vertical direction of at least a mast section of the second mast which is connected to the second guide device and at least a mast section of the first mast which is connected to the first guide device. So, when a mast section of the second mast is moved vertically upwards or downwards relative to a mast section of the first mast, and that mast section of the first mast is connected—either directly or indirectly—to the first guide device, and the respective mast section of the second mast is connected—either directly or indirectly—to the second guide device, then this movement is guided by the guide system when the guide system is in the connected state.

Optionally, when the guide system is in the connected state, the guide system prevents movement of a mast section of the second mast which is connected to the second guide device relative to at least a mast section of the first mast which is connected to the first guide device in all other directions than the longitudinal directions of first and second masts.

The guide system further has a disconnected state in which the first guide device and the second guide device are disconnected from each other. In the disconnected state, the guide system preferably guides no movement of a mast section of the second mast and a mast section of the first mast relative to each other. In the disconnected state, mast sections of the second mast and mast sections of the first mast may move relative to each other, but these movements are preferably not guided by the guide system.

The crane according to the invention further comprises a mast section mounting device. The mast section mounting device is adapted to—during assembly of the crane—move at least a mast section of the second mast which is connected to the guide system vertically upwards relative to at least a mast section of the first mast while the guide system is in the connected state. The mast section mounting device is optionally adapted to engage the lowest mast section of the second mast.

The crane according to the invention further comprises a mast section locking device. The mast section locking device which is adapted to lock at least a mast section of the second mast in a fixed position relative to at least a mast section of the first mast when the guide system is in the connected state.

The crane according to the invention further comprises a mast pivot actuator, which is adapted to pivot the first mast and the second mast away from each other when the guide system is in the disconnected state.

The crane according to the invention allows efficient and expedient assembly and disassembly at the site at which the crane is to be operated. A relatively small area at this site suffices to the assemble and disassemble the crane according to the invention.

This is mainly due to the fact that the second mast can be assembled in vertical direction. The assembly and disassembly take place from the lowest part of the second mast, which avoids working at significant heights. This is practical and eliminates the necessity to use large auxiliary cranes during assembly and disassembly.

The crane also allows to extend the first mast in its longitudinal direction by adding subsequent mast sections after the second mast has been fully or partially assembled. This lengthwise extension of the first mast can be carried out while the first mast is arranged vertically. The lengthwise extension of the first mast also takes place from the lowest part of the first mast, so that also during the lengthwise extension of the first mast, working at significant heights is avoided.

In a possible embodiment, the guide system comprises at least one guide rail. This guide rail is mounted to an exterior surface of at least one mast section of at least one of the first mast and the second mast, and extends in the longitudinal direction of the mast section to which it is mounted. Optionally, at least one mast section of both the first mast and the second mast are provided with a guide rail.

In a possible embodiment, multiple adjacent mast sections of the first mast and/or multiple adjacent mast sections of the second mast are provided with a guide rail in such a way that the guide rails of adjacent mast sections together form a continuous combined guide rail in which the individual guide rails are aligned with each other in the longitudinal direction of the respective mast.

In a possible embodiment, the guide system comprises a guide follower, e.g. a guide follower wheel. In the connected state of the guide system, the guide follower for example engages an exterior surface of the first mast or the second mast, and when the second mast section is moved relative to the first mast, the guide follower runs over this exterior surface. Alternatively or in addition, in the connected state of the guide system the guide follower is arranged in or at a guide rail which is mounted to a mast section of the second mast, which guide rail extends in longitudinal direction of the respective mast section. Alternatively or in addition, in the connected state of the guide system the guide follower is arranged in or at a guide rail which is mounted to a mast section of the first mast, which guide rail extends in longitudinal direction of the respective mast section.

Optionally, in this embodiment the shape of the guide follower and the shape of the guide rail or/and exterior surface of the mast which is engaged by the guide follower are such that movement of a mast section of the second mast relative to the first mast is prevented in all directions except in the longitudinal direction of the mast section.

Optionally, the guide system comprises a plurality of guide followers. The guide followers are or comprise guide wheels, which in the connected state of the guide system are arranged in or at a guide rail. The guide rail for example comprises a movable side wall, which has an active position and a passive position. In side wall is in the active position when the guide system is in the connected state. In the active position the moveable side wall prevents movement of a mast section of the second mast relative to the first mast in all directions except in the longitudinal direction of the mast section. In the inactive position, the moveable side wall no longer prevents the movements of the mast section of the second mast it did prevent when it was in the active position. The inactive position of the moveable side wall allows to bring the guide system from the connected state into the disconnected state.

In a possible embodiment, the first mast is a back mast and the second mast is a main boom. In this embodiment optionally at least the second mast is provided with at least one hoisting device which is adapted to hoist a load. Optionally, both the first mast and the second mast are provided with a hoisting device or with multiple hoisting devices.

In an alternative embodiment, the first mast is a main boom and the second mast is a back mast. In this alternative embodiment, optionally at least the first mast is provided with at least one hoisting device which is adapted to hoist a load. Optionally, both the first mast and the second mast are provided with a hoisting device or with multiple hoisting devices.

In a possible embodiment, the mast section mounting device comprises a hydraulic jack which is adapted to push at least one mast section of the second mast vertically upwards during assembly of the crane.

Alternatively or in addition, wherein the mast section mounting device comprises a cable, which cable is adapted to pull at least one mast section of the second mast vertically upwards during assembly of the crane. Optionally, this cable forms a guy wire between the first mast and the second mast in the assembled crane.

In a possible embodiment, the mast section mounting device comprises a carriage, which is moveable parallel to the longitudinal axis of the first mast. The carriage is adapted to engage a mast section of the second mast when that mast section is in a first position at a vertical distance from the crane base, to hold that mast section during transfer of that mast section from the first position to a second position which is at a different distance from the crane base than the first position, and to release that mast section after that mast section has been fixed in the second position.

Optionally, the carriage is adapted to engage the lowest mast section of the second mast.

In a possible embodiment, the mast section mounting device comprises a carriage, which is moveable parallel to the longitudinal axis of the second mast. In this embodiment, the carriage is adapted to engage a mast section of the first mast when that mast section is in a first position at a vertical distance from the crane base, to hold that mast section during transfer of that mast section from the first position to a second position which is at a different distance from the crane base than the first position, and to release that mast section after that mast section has been fixed in the second position.

Optionally, the carriage is adapted to engage the lowest mast section of the first mast.

In a possible embodiment, the mast section mounting device further which is adapted to—during assembly of the crane—move vertically upwards at least a mast section of the first mast which is connected to the guide system relative to at least a mast section of the second mast when the guide system is in the connected state. This allows to extend the length of the first mast after at least a part of the second mast has been assembled.

In a possible embodiment, the mast pivot actuator comprises a push-off-and-hold device. The push-off-and-hold device has an active state and an inactive state. In the active state, push-off-and-hold device is connected to both the first mast and the second mast. In the inactive state, push-off-and-hold device is disconnected from at least one of the first mast and the second mast. This embodiment allows a controlled pivoting of the second mast relative to the first mast after the guide system has been brought into the disconnected state, at least during a first portion of the pivoting movement.

In a possible embodiment, the mast pivot actuator comprises a connection between the top mast section of the first mast or the top mast section of the second mast and a strong point of the crane or outside the crane. The connection is for example a cable or a rod. The strong point of the crane is for example a ballast or outrigger of the crane. A strong point outside the crane is for example a heavy object or rock face outside the crane.

In a first variant, the connection has a length that can be varied. By reducing the length of the connection, the first mast pivots away from the second mast or the second mast pivots away from the first mast.

In second variant, the strong point may be moveable relative to the top mast section to which it is connected via the connection. By moving the strong point relative to the first and/or second mast, the first mast can be made to pivot away from the second mast or the second mast can be made to pivot away from the first mast.

In a third variant, both the length of the connection can be varied and the strong point is moveable relative to the top mast section to which it is connected via the connection.

In a possible embodiment, the length of the main boom of the crane according to the invention is for example between 60 meters and 200 meters, e.g. between 80 meters and 180 meters, optionally between 100 meters and 150 meters.

In a possible embodiment, the length of the back mast of the crane according to the invention is for example between 30 meters and 150 meters, e.g. between 50 meters and 120 meters, optionally between 60 meters and 100 meters.

In a possible embodiment, the length of the main boom of the crane is between 120 meters and 180 meters, and the length of the back mast is between 30 meters and 90 meters. Optionally in this embodiment, the length of the main boom of the crane is 150 meters, and the length of the back mast is 60 meters.

In a possible embodiment, the main boom is longer than the back mast. In an alternative embodiment, the back mast is longer than the main boom.

In a possible embodiment, the first mast fixing device comprises a ballast and at least one connection element which releasably connects the ballast to the first mast. The connection element may for example be a cable, a tube or a hydraulic cylinder. In case multiple connection elements are present, a combination of cables, tubes or and/or hydraulic cylinders may be used.

When the crane is operated—so, after it has been fully assembled—the first mast fixing device may be disconnected entirely from the remainder of the crane. Alternatively, at least a part of the first mast fixing device remains connected to the remainder of the crane. For example, a ballast of the first fixing device may be used as a ballast of the crane during operation.

In a possible embodiment, the first mast fixing device is further adapted to releasably fix the second mast in a vertical position relative to the crane base. This is in particular advantageous when it is desired to extend the length of the first mast after the second mast has been fully or partially assembled.

In a possible embodiment, the crane further comprises a second mast fixing device, which is adapted to releasably second the first mast in a vertical position relative to the crane base.

In a possible embodiment, the crane according to the invention is provided with anchoring cables to stabilize the crane in conditions of strong winds. These anchoring cables are optionally connected to the uppermost mast section of the first mast and/or the uppermost mast section of the second mast, and/or to one or more other sufficiently strong points of the crane and/or to one or more sufficiently strong points outside the crane.

The invention further pertains to a method for assembling a crane, which crane is a crane according to the invention.

This method according to the comprises the following steps:

connecting the first mast to the first pivot on the crane base, and subsequently fixing the first mast relative to the crane base in a vertical position by the first mast fixing device, arranging a top mast section of the second mast—which top mast section is provided with at least a part of the second guide device—adjacent to and outside of the first mast at a first position which is at a vertical distance from the crane base, and connecting the at least part of the second guide device to the first guide device on the first mast, therewith bringing the guide system in the connected state, moving the top mast section of the second mast vertically upwards by the mast section mounting device, this movement being guided by the guide system, and subsequently fixing the top mast section of the second mast relative to the first mast by the mast section locking device at a second position which is at a larger vertical distance from the crane base than the first position, fixing a first intermediate mast section of the second mast to a lower end of the top mast section of the second mast to build up the second mast, connecting the first intermediate mast section of the second mast to the second pivot on the crane base, bringing the guide system in the disconnected state, pivoting the second mast away from the first mast by the mast pivot actuator, releasing the fixation of the first mast relative to the crane base by the first mast fixing device.

In the method according to the invention, first the first mast is connected to the first pivot on the crane base. The first mast at this time can either be assembled to its full final length, or it can be shorter than the full final length. In the latter case, the first mast will be extended in length later on.

After the first mast has been connected to the first pivot, the first mast is fixed relative to the crane base in a vertical position by the first mast fixing device. This step may include bringing the first mast into a vertical position. For example, in case the first mast is assembled horizontally, e.g. on the ground, the first mast is brought from the horizontal position into the vertical position, e.g. by an auxiliary crane.

"Vertical" means extending at 90° relative to the horizontal, and includes small unintended and/or small undeliberate deviations therefrom. In general, the deviation from the pure vertical direction will not be more than about 5°.

Then, a top mast section of the second mast—which top mast section is provided with at least a part of the second guide device—is arranged adjacent to and outside of the first mast at a first position. This first position at a vertical distance from the crane base. The top mast section of the second mast will form the top portion of the second mast in the assembled crane. Optionally, the top mast section is provided with sheaves and/or cables already when it is arranged in the first position. The top mast section has an upper end and a lower end, and a longitudinal axis.

Then, the at least part of the second guide device is connected to the first guide device on the first mast, therewith bringing the guide system in the connected state.

Then, the top mast section of the second mast is moved vertically upwards by the mast section mounting device. This movement is guided by the guide system. Then, the top mast section of the second mast is fixed relative to first mast at a second position. The fixing is carried out by the mast section locking device. The second position is at a larger vertical distance from the crane base than the first position.

Then, a first intermediate mast section of the second mast is fixed to a lower end of the top mast section of the second mast. When the second mast is fully assembled, the second mast comprises the top mast section and at least one intermediate mast section. In general, the fully assembled second mast will comprise a top mast section and a plurality of intermediate mast sections. The intermediate mast sections may all have the same length, but alternatively intermediate mast sections of different lengths may be used to assemble the second mast. This may be advantageous for example when the top mast section and/or the equipment which is fixed to the top mast section (such as sheaves and cables) is relatively heavy. In that case, it may be desirable that relatively short intermediate mast sections are used just below the top mast section. Optionally also a relatively short top mast section is used in this case.

The top mast section may have a length which is the same as or different from the length of the intermediate mast section just below the top mast section.

After the first intermediate mast section is fixed to the lower end of the top mast section of the second mast, the first intermediate mast section of the second mast is connected to the second pivot on the crane base. This connection can be either directly or indirectly. For example, when one or more subsequent intermediate mast sections are connected to the first intermediate mast section of the second mast in order to obtain the desired length of the second mast, the connection of the first intermediate mast section of the second mast to the second pivot is via this subsequent mast section or these subsequent mast sections.

After connection of the first intermediate mast section of the second mast, either directly or indirectly, to the second pivot, the guide system is brought in the disconnected state. In the disconnected state, the mast sections of the second mast can move relative to the first mast in other directions than parallel to the longitudinal axis of the second mast. For example, the mast sections of the second mast can move away from the first mast.

Then, the second mast is pivoted away from the first mast by the mast pivot actuator.

Subsequently, the fixation of the first mast relative to the crane base by the first mast fixing device is released. So, the first mast can pivot again about a horizontal axis relative to the crane base. Optionally, after this release of the fixing, the first mast can also pivot about a vertical axis.

In a possible embodiment of the method according to the invention, the following additional steps are performed after the step of fixing a first intermediate mast section of the second mast to a lower end of the top mast section of the second mast and before the step of connecting the first intermediate mast section to a second pivot on the crane base:

releasing the fixation of the top mast section of the second mast to the first mast, and jointly moving the top mast section and the first intermediate mast section of the second mast vertically upwards, which movement is guided by the guide system, thereby bringing the top mast section of the second mast into a third position which is at a larger vertical distance from the crane base than the second position, fixing the top mast section and the first intermediate mast section of the second mast relative to the first mast by the mast section locking device, connecting a subsequent intermediate mast section of the second mast to a lower end of the first intermediate mast section of the second mast to further build up the second mast.

In this embodiment, the step of connecting the first intermediate mast section of the second mast to the second pivot on the crane base is realized by connecting the subsequent intermediate mast section to the second pivot on the crane base.

With the method according to this embodiment, a second mast is assembled which contains multiple intermediate mast sections.

Optionally, this embodiment comprises the following additional steps:

releasing the fixation of the top mast section, first intermediate mast section and subsequent intermediate mast section of the second mast to the first mast, and jointly moving the top mast section, the first intermediate mast section and subsequent intermediate mast section of the second mast vertically upwards, which movement is guided by the guide system, thereby bringing the top mast section of the second mast into a fourth position which is at a larger vertical distance from the crane base than the third position, fixing the top mast section, the first intermediate mast section and the subsequent intermediate mast section of the second mast relative to the first mast by the mast section locking device, connecting a further subsequent intermediate mast section of the second mast to a lower end of the subsequent intermediate mast section of the second mast to further build up the second mast.

By repeating these steps, and every time fixing the top mast section at a position further away from the crane base, the second mast can be assembled to the desired length.

In a possible embodiment of the method according to the invention, the step of connecting the first intermediate mast section to a second pivot on the crane base comprises:

arranging a connection mast section between a lower end of the first intermediate mast section and the second pivot, and connecting a first end of the connection mast section to the lower end of the first intermediate mast section of the second mast and connecting a second end of the connection mast section to the second pivot.

In case the lowest mast section of the second mast is a subsequent intermediate mast section, the first end of the connection mast section is connected to the lower end of this subsequent intermediate mast section of the second mast. The first intermediate mast section is then connected to the first end of the connection mast section via this (and optionally via other subsequent mast sections if those are present) lowest subsequent intermediate mast section.

Optionally in the embodiment in which the connection mast section is used, the connection mast section has a longitudinal axis which extends at an angle relative to the vertical direction after the second end of the connection mast section has been connected to the second pivot. The first end of the connection mast section is connected to the lower end of the first intermediate mast section via a third pivot. The first intermediate mast section and the top mast section of the second mast are pivoted jointly about the third pivot to make that the first intermediate mast section and the top mast section of the second mast comes to extend coaxially with the connection mast section. After this pivoting, the first intermediate mast section is rotationally fixed relative to the connection mast section so the first intermediate mast section can no longer rotate about the third pivot.

In case the lowest mast section of the second mast is a subsequent intermediate mast section, the first end of the connection mast section is connected via the third pivot to the lower end of this subsequent intermediate mast section of the second mast. The first intermediate mast section is then rotationally fixed to the connection mast section via this (and optionally via other subsequent mast sections if those are present) lowest subsequent intermediate mast section.

In a possible embodiment of the method according to the invention, the top mast section of the second mast is pulled upwards by a cable. If one or more intermediate mast sections are connected to the top mast section of the second mast, the top mast section and the one or more intermediate mast sections of the second mast are preferably jointly pulled upwards by the cable. This embodiment allows a relatively rapid assembly of the crane.

Optionally, this cable forms a guy wire between the first mast and the second mast after pivoting the second mast away from the first mast by the mast pivot actuator.

In a possible embodiment of the method according to the invention, the top mast section of the second mast is pushed upwards by a hydraulic jack. If one or more intermediate mast sections are connected to the top mast section of the second mast, the top mast section and the one or more intermediate mast sections of the second mast are preferably jointly pushed upwards by the hydraulic jack. Optionally, multiple hydraulic jacks are applied.

In a possible embodiment, the top mast section of the second mast is moved upwards by at least one hydraulic jack in combination with one or more cables. If one or more intermediate mast sections are connected to the top mast section of the second mast, the top mast section and the one or more intermediate mast sections of the second mast are preferably jointly moved upwards by at least one hydraulic jack in combination with one or more cables.

In a possible embodiment of the method according to the invention, the second mast is pivoted away from the first mast by the following steps:

- pivoting the second mast away from the first mast over a first opening angle by the mast pivot actuator, which mast pivot actuator is connected to both the first mast and the second mast,
- releasing the connection between the mast pivot actuator and the first mast and/or the second mast,
- pivoting the second mast away from the first mast over a further second opening angle under the influence of gravity.

This embodiment allows to pivot the second mast away from the first mast in a controlled manner.

In a possible embodiment of the method according to the invention, before bringing the guide system in the disconnected state, the following additional steps are performed:

- fixing the second mast relative to the crane base in a vertical position,
- disconnecting a lower end of a first mast section of the first mast from the first pivot (optionally, this involves releasing the fixation of the first mast relative to the crane base.)
- moving the first mast section of the first mast vertically upwards by the mast section mounting device, this movement being guided by the guide system, and subsequently fixing the first mast section of the first mast relative to second mast by the mast section locking device,
- fixing a first intermediate mast section of the first mast to a lower end of the first mast section of the first mast to further build up the first mast,
- connecting the first intermediate mast section of the first mast to the first pivot on the crane base.

This embodiment allows the extend the length of the first mast after the second mast has been fully or partially assembled.

Optionally, in this embodiment, one or more subsequent intermediate mast sections are subsequently added to the first mast. Each subsequent intermediate mast section is connected to the lower end of the (until then) lowest intermediate mast section of the first mast. This way, the first mast can be extended to its desired length.

Optionally, in this embodiment, after the first mast has obtained its desired length, the fixing of the second mast in vertical direction relative to the crane base can be released, and the fixing of the first mast in vertical direction relative to the crane base can be re-established. The lower end of the lowest intermediate mast section of the second mast can then be disconnected from the second pivot, The second mast can then be moved vertically upwards by the mast section mounting device. This movement is again guided by the guide system. Then the second mast is fixed relative to first mast by the mast section locking device, and further subsequent intermediate mast sections can be added in the same way as described above in relation to the addition of subsequent intermediate mast sections to build up the second mast to the desired length.

In a possible embodiment of the method according to the invention, during at least a part of the assembly of the crane, the second mast is longer than the first mast.

In a possible embodiment of the method according to the invention, the top mast sections and/or the intermediate mast sections are assembled at the site where the crane is assembled and operated, and/or nearby this site.

The present invention also relates to a method of assembling a crane mast section, e.g. to be used in conjunction with a crane and/or method as described herein or in another crane and/or method, which mast section is for example to form a top mast section or an intermediate mast section, comprises the following steps:

- fixing a first corner tube in a vertical position,
- fixing a second corner tube in a vertical position, at a first horizontal distance from the first corner tube, which first horizontal distance corresponds to the width of the mast section to be assembled in a first direction,
- fixing a third corner tube in a vertical position, at a second horizontal distance from the second corner tube, which second horizontal distance corresponds to the width of the mast section to be assembled in a second direction which is perpendicular to the first direction,
- fixing a fourth corner tube in a vertical position, at a horizontal distance in the first direction from the third corner tube which corresponds to the first horizontal distance and at horizontal distance in the second direction from the first corner tube which corresponds to the second horizontal distance,
- connecting the first corner tube and the second corner tube to each other by arranging at least one connector tube between the first corner tube and the second corner tube,
- connecting the second corner tube and the third corner tube to each other by arranging at least one connector tube between the second corner tube and the third corner tube,
- connecting the third corner tube and the fourth corner tube to each other by arranging at least one connector tube between the third corner tube and the fourth corner tube,
- connecting the fourth corner tube and the first corner tube to each other by arranging at least one connector tube between the fourth corner tube and the first corner tube.

In an embodiment the crane mast section assembly method comprises the use of a corner tubes support structure having a base frame provided with a first, second, third, and fourth corner tube fixing device at locations corresponding to said widths of the mast section to be assembled in said first and second directions, wherein each corner tube fixing device is adapted or configured to releasably fix a lower end of a corner tube that is positioned in vertical position on the base frame, and wherein the method comprises arranging each of said first to fourth corner tubes vertically on the corner tube support structure so that a lower end thereof is fixed by said respective first to fourth corner tube fixing device, and further comprises arranging said connector tubes to complete the mast section, and further comprises releasing the corner tube fixing devices and removing the completed mast section from the corner tubes support structure, e.g. using a mobile crane.

In an embodiment the base frame of the corner tubes support structure is embodied to allow for different locations of the corner tube fixing devices thereon to allow for the use in the course of different cross-sectional crane mast sections.

In an embodiment each corner tube fixing device comprises a locking member and locking member actuator, e.g. a hydraulically actuable locking member, e.g. a locking pin insertable into a locking hole provided in the lower end of the corner tube.

In an embodiment each corner tube fixing device comprises a stabbing member that is adapted enter into the lower end of a corner tube.

In an embodiment each of the corner tubes is prefabricated to have along the length thereof fastening members, e.g. plates provided with one or more holes therein, adapted to secure thereto an end of a connector tube, e.g. the connector tubes having at axial ends thereof one or more plates provided with holes allowing to secure the respective end to the corner tube by means of a pin or bolt.

Preferably some of the connector tubes are arranged diagonally between two corner tubes whereas in embodiments some of the connector tubes are arranged horizontally between two corner tubes.

In a variant of this method of assembling a crane mast section, which mast section is for example to form a top mast section or an intermediate mast section of a crane, the first corner tube and the second corner tube are connected to each other by arranging multiple connector tubes between the first corner tube and the second corner tube.

In a variant of this method of assembling a mast section, which mast section is to form a top mast section or an intermediate mast section, the second corner tube and the third corner tube are connected to each other by arranging multiple connector tubes between the second corner tube and the third corner tube.

In a variant of this method of assembling a mast section, which mast section is to form a top mast section or an intermediate mast section, the third corner tube and the fourth corner tube are connected to each other by arranging multiple connector tubes between the third corner tube and the fourth corner tube.

In a variant of this method of assembling a mast section, which mast section is to form a top mast section or an intermediate mast section, the fourth corner tube and the first corner tube are connected to each other by arranging multiple connector tubes between the fourth corner tube and the first corner tube.

In a variant of this method of assembling a mast section, which mast section is to form a top mast section or an intermediate mast section, the first corner tube and the third corner tube are connected to each other by arranging at least one, and optionally multiple, connector tubes between the first corner tube and the third corner tube.

In a further variant of this method of assembling a mast section, which mast section is for example to form a top mast section or an intermediate mast section, first the four corner tubes are fixed in the vertical position and at the desired mutual horizontal distances, preferably using the mentioned corner tubes support structure. Then, all connector tubes between the first and the second corner tubes are arranged between the first and the second corner tubes. Subsequently, all connector tubes between the second and the third corner tubes are arranged between the second and the third corner tubes. Subsequently, all connector tubes between the third and the fourth corner tubes are arranged between the third and the fourth corner tubes. Then, all connector tubes between the fourth and the first corner tubes are arranged between the fourth and the first corner tubes.

In a further variant of this method of assembling a crane mast section, which mast section is for example to from a top mast section or an intermediate mast section, first the first and second corner tubes are fixed in a vertical position, with the second corner tube at the first horizontal distance in a first horizontal direction from the first corner tube. Then, all connector tubes between the first and the second corner tubes are arranged between the first and the second corner tubes. Then, the third corner tube is fixed in a vertical position, at a second horizontal distance in a direction perpendicular to the first horizontal direction from the second corner tube. Subsequently, all connector tubes between the second and the third corner tubes are arranged between the second and the third corner tubes. Then, the fourth corner tube is fixed in a vertical position, at a first horizontal distance in the first horizontal direction from the third corner tube and at a second horizontal direction perpendicular to the first distance from the first corner tube. Subsequently, all connector tubes between the third and the fourth corner tubes are arranged between the third and the fourth corner tubes. Then, all connector tubes between the fourth and the first corner tubes are arranged between the fourth and the first corner tubes.

Optionally the corner tubes have an octagonal, circular or rectangular cross sectional shape.

It will be appreciated that the assembly methods and mentioned corner tubes support structure may also be configured and used in the course of the assembly of crane mast sections having a cross-section that is not square or rectangular, e.g. for crane mast sections that are of triangular, or of hexagonal cross-section. In those embodiments the number of corner tubes may e.g. be three or six, or in yet another embodiment eight, etc.

Optionally, the cross sectional size of at least one of the corner tubes is different from the cross sectional size of another corner tube of the mast section. For example, the first and second corner tubes can have the same first cross sectional size, and the third and fourth corner tubes can have the same second cross sectional size, with the first cross sectional size of the first and second corner tube being different from the second cross sectional size of the third and fourth corner tube.

After assembling one or more mast sections in accordance with this method, the thus assembled mast section or mast sections may be used as top mast section or intermediate mast section in the crane according to the invention and/or in the method for assembling a crane in accordance with the invention. However, this method for assembling a mast section can also be used to assemble a mast section for a different type of crane or for use in a different method for assembling a crane.

The invention further pertains to a method for disassembling a crane. The crane to be disassembled in accordance with this method is a crane according to the invention.

This further method according to the invention comprises the following steps:

- fixing the first mast in a vertical position relative to the crane base by the first mast fixing device,
- pivoting the second mast towards the first mast,
- bringing the guide system in the connected state, and fixing the second mast relative to the first mast in vertical direction with the top mast section of the second mast in a second position which is at a vertical distance from the crane base, disconnecting the first intermediate mast section of the second mast from the second pivot on the crane base, releasing the first intermediate mast section of the second mast from a lower end of the top mast section of the second mast, and removing the first intermediate mast section, releasing the fixation in vertical direction of the second mast relative to the first mast, and moving the top mast section of the second mast vertically downwards into a first position by the mast section mounting device, which first position is at a smaller vertical distance from the crane base than the second position, this movement being guided by the guide system, bringing the guide system into the disconnected state, removing the top mast section of the second mast, releasing the fixation of the first mast relative to the crane base, disconnecting the first mast from the first pivot on the crane base, and removing the first mast.

BRIEF DESCRIPTION OF THE DRAWINGS

The invention will be described in more detail below under reference to the drawing, in which in a non-limiting manner exemplary embodiments of the invention will be shown. The drawing shows in.

DETAILED DESCRIPTION

Figure 1:
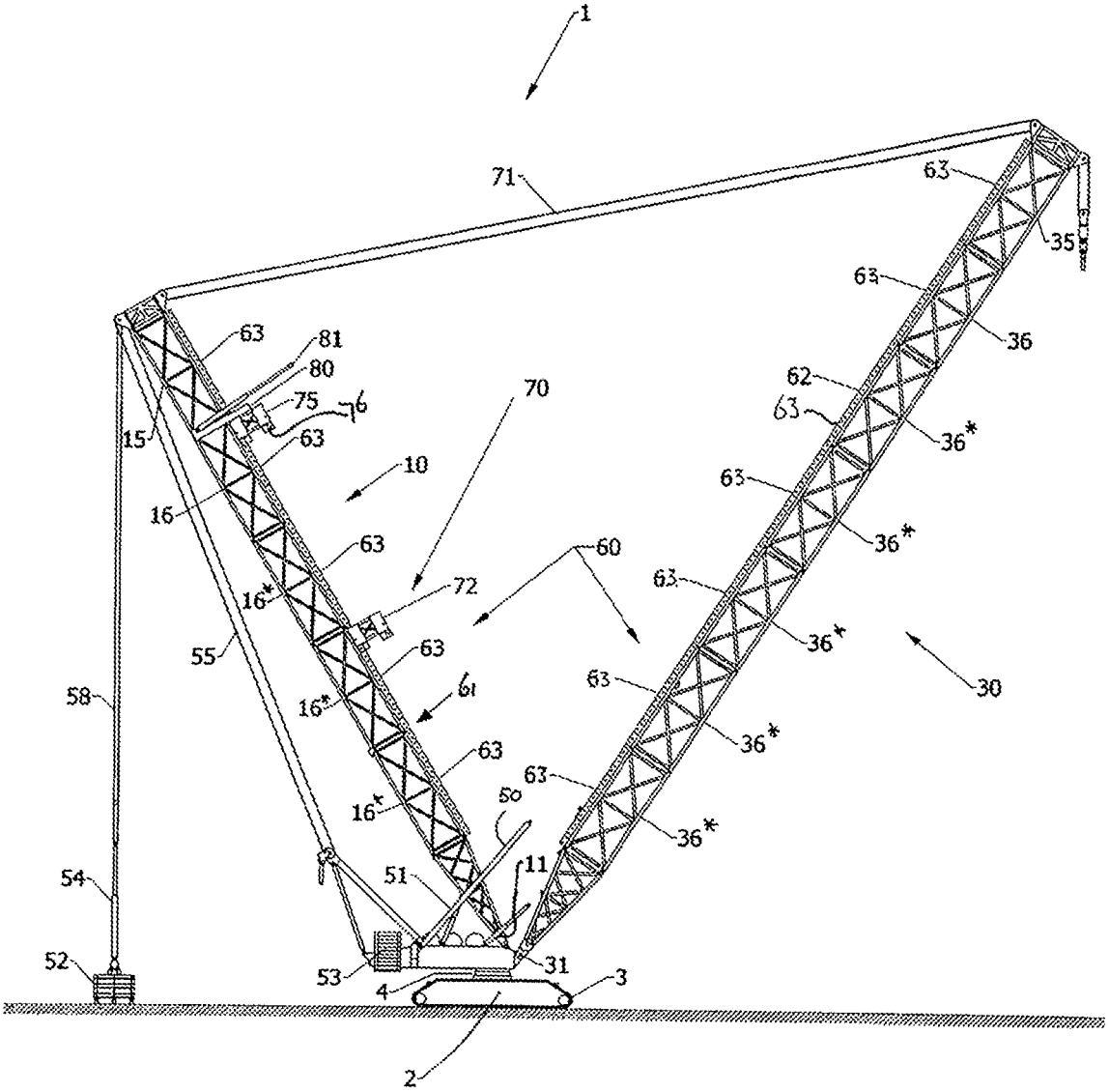
FIG. 1: a first embodiment of a crane according to the invention.

FIG. 1 shows a first embodiment of a crane 1 according to the invention.

The crane 1 comprises a crane base 2, which in this embodiment is a chassis of a crawler crane. The crane base 2 in this embodiment comprises two tracks 3 and a slewing ring 4. The crane base 2 is arranged on a support surface of the working area. The support surface is for example a part of the ground which is provided with loose steel plates for better consistency.

The crane 1 further comprises a first mast 10. In this embodiment, the first mast 10 is the back mast of the crane 1. The first mast 10 is pivotable about a first pivot 11 which is arranged at the crane base 2, in this embodiment just above the slewing ring 4. The first pivot 11 has a horizontal pivot axis. The first mast comprises a plurality of mast sections 15, 16, 16*. Optionally each mast section is individually assembled on site at the working location from separate tubes and/or beams, which are for example connected to each other by pin—hole connections. The first mast 10 has a longitudinal axis, which extends in the direction of the length of the first mast 10.

In this embodiment, the first mast 10 is a lattice mast which is formed as a single boom, alternatively, in an embodiment not shown in the drawings, the first mast has an A-shape or a Y-shape.

The crane 1 further comprises a second mast 30. In this embodiment, the second mast 30 is the main boom of the crane 1. The second mast 30 is pivotable about a second pivot 31 which is arranged at the crane base 2, in this embodiment just above the slewing ring 4. The second pivot 31 has a horizontal pivot axis. The second mast comprises a plurality of mast sections 35, 36, 36*. Optionally each mast section is individually assembled on site at the working location from separate tubes and/or beams, which are for example connected to each other by pin-hole connections. The second mast 30 has a longitudinal axis, which extends in the direction of the length of the second mast 30.

In this embodiment, the second mast 30 is a lattice mast which is formed as a single boom, alternatively, in an embodiment not shown in the drawings, the first mast has an A-shape or a Y-shape.

In a this embodiment, the horizontal pivot axis of the first pivot 11 is parallel to the horizontal pivot axis of the second pivot 31. In this embodiment, the first pivot 11 and the second pivot 31 are spaced apart from each other. This helps to reduce the local ground pressure under the crane base 2.

In the embodiment of FIG. 1, the crane 1 further comprises a first mast fixing device 50 which is adapted to releasably fix the first mast 10 in a vertical position relative to the crane base 2 during at least a part of the assembly and/or disassembly of the crane 1. The first mast fixing device 50 in this embodiment comprises fixing rods 51, which extend between the first mast 10 and the crane base 2 when the first mast 10 is fixed into the vertical position. During the operation of the crane 1, the fixing rods 51 are disconnected from at least one of the first mast 10 and the crane base 2. In this embodiment, the first mast fixing device 50 further comprises a first ballast 52 and a second ballast 53 which are used to further fix the first mast 10 in a vertical position relative to the crane base 2 during at least a part of the assembly and/or disassembly of the crane 1. The first ballast 52 is arranged at a distance from the crane base 2 and is connected to the top of the first mast 10 via connection elements 54, 58. The connection elements 54, 58 may for example comprise one or more cables, tubes, beams and/or hydraulic cylinders. The second ballast 53 is mounted on the crane base 2, and is connected to the top of the first mast 10 via connection element 55. Connection element 55 may for example comprise one or more cables, tubes, beams and/or hydraulic cylinders. The first ballast 52 and/or the second ballast 53 may be used as ballasts during the operation of the crane 1 as well. If desired, the first ballast 52 may be arranged at a different position during the operation of the crane 1 than during assembly and/or disassembly of the crane 1. Optionally, the first ballast 52 is used as a "floating ballast" (i.e. arranged at a level above the ground) during operation of the crane 1.

The first mast fixing device 50 is adapted to temporarily fix the first mast 10 in a vertical position, and to release this fixing when it is no longer required.

When the crane is operated—so, after it has been fully assembled—the first mast fixing device 50 may be disconnected entirely from the remainder of the crane 1. Alternatively, at least a part of the first mast fixing device 50 (e.g. the first ballast 52 and/or the second ballast 53) remains connected to the remainder of the crane 1.

The crane of FIG. 1 further comprises a guide system 60. The guide system 60 comprises a first guide device 61 connected to an exterior surface of the first mast 10 and a second guide device 62 which is connected to an exterior surface of the second mast 30.

The guide system 60 has a connected state and a disconnected state. In the connected state, the longitudinal axis of the first mast 10 and the longitudinal axis of the second mast 30 both extend vertically and parallel to each other. Small unintended and/or undeliberate deviations may occur. In the connected state, the first guide device 61 and the second guide device 62 are movably connected to each other. The guide system 60 is adapted to guide relative movement in vertical direction of at least a mast section 35, 36 of the second mast 30 which is connected to the second guide device 62 and at least a mast section 15, 16, 16* of the first mast 10 which is connected to the first guide device 61. So, when a mast section 35, 36, 36* of the second mast 30 is moved vertically upwards or downwards relative to a mast section 15, 16, 16* of the first mast 10, and that mast section 15, 16, 16* of the first mast 10 is connected—either directly or indirectly—to the first guide device 61, and the respective mast section 35, 36, 36* of the second mast 30 is connected—either directly or indirectly—to the second guide device 62, then this movement is guided by the guide system 60 when the guide system 60 is in the connected state.

In the embodiment of FIG. 1, when the guide system 60 is in the connected state, the guide system 60 prevents movement of a mast section 35, 36, 36* of the second mast 30 which is connected to the second guide device 62 relative to at least a mast section 15, 16, 16* of the first mast 10 which is connected to the first guide device 61 in all other directions than the longitudinal directions of first and second masts 10, 30.

The guide system 60 further has a disconnected state in which the first guide device 61 and the second guide device 62 are disconnected from each other. In the disconnected state, the guide system 60 preferably guides no movement of a mast section 35, 36, 36* of the second mast 30 and a mast section 15, 16, 16* of the first mast 10 relative to each other. In the disconnected state, mast sections 35, 36, 36* of the second mast 30 and mast sections 15, 16, 16* of the first mast 10 may move relative to each other, but these movements are preferably not guided by the guide system 60.

In the embodiment of FIG. 1, the guide system 60 comprises multiple guide rails 63. The guide rails 63 are mounted to an exterior surface of at least one mast section 15, 16, 16*, 35, 36, 36* of at least one of the first mast 10 and the second mast 30, and extend in the longitudinal direction of the mast section to which they are is mounted. In the embodiment of FIG. 1, at least one mast section 15, 16, 16*, 35, 36, 36* of both the first mast 10 and the second mast 30 are provided with a guide rail.

In the embodiment of FIG. 1, multiple adjacent mast sections 15, 16, 16* of the first mast 10 and multiple adjacent mast sections 35, 36, 36* of the second mast 30 are provided with a guide rail 63 in such a way that the guide rails 63 of adjacent mast sections together form a continuous combined guide rail in which the individual guide rails are aligned with each other in the longitudinal direction of the respective mast 10, 30.

In the embodiment of FIG. 1, the crane 1 further comprises a mast section mounting device 70. The mast section mounting device 70 is adapted to—during assembly of the crane 1—move at least a mast section 35, 36, 36* of the second mast 30 which is connected to the guide system 60 vertically upwards relative to at least a mast section 15, 16, 16* of the first mast 10 while the guide system 60 is in the connected state.

In the embodiment of FIG. 1, the mast section mounting device 70 comprises a cable 71, This cable 71 is optionally adapted to pull at least one mast section 35, 36, 36* of the second mast 30 vertically upwards during assembly of the crane 1. In the embodiment of FIG. 1, this cable 71 forms a guy wire between the first mast 10 and the second mast 30 in the assembled crane 1.

Optionally, in the embodiment of FIG. 1, the mast section mounting device 70 additionally comprises a hydraulic jack 76 which is adapted to push at least one mast section 35, 36, 36* of the second mast 30 vertically upwards during assembly of the crane 1.

In an alternative embodiment, the mast section mounting device 70 comprises a hydraulic jack which is adapted to move at least one mast section 35, 36, 36* of the second mast 30 vertically upwards during assembly of the crane 1 instead of a cable 71.

In the embodiment of FIG. 1, the mast section mounting device 70 comprises a carriage 72. The carriage 72 is moveable parallel to the longitudinal axis of the first mast 10. The carriage 72 is adapted to engage a mast section 35, 36, 36* of the second mast 30 when that mast section 35, 36, 36* is in a first position at a vertical distance from the crane base 2, to hold that mast section 35, 36, 36* during transfer of that mast section 35, 36, 36* from the first position to a second position which is at a different distance from the crane base 2 than the first position, and to release that mast section 35, 36, 36* after that mast section 35, 36, 36* has been fixed in the second position. In this embodiment, the carriage is adapted to engage the lowest mast section 35, 36, 36* of the second mast 30.

In the embodiment of FIG. 1, the mast section mounting device 70 further which is adapted to—during assembly of the crane—move vertically upwards at least a mast section 15, 16, 16* of the first mast 10 which is connected to the guide system 60 relative to at least a mast section 35, 36, 36* of the second mast 30 when the guide system 60 is in the connected state. This allows to extend the length of the first mast 10 after at least a part of the second mast 30 has been assembled.

The crane 1 of the embodiment of FIG. 1 further comprises a mast section locking device 75, which is adapted to lock at least a mast section 35, 36, 36* of the second mast 30 in a fixed position relative to at least a mast section 15, 16, 16* of the first mast 10 when the guide system 60 is in the connected state.

The crane of FIG. 1 further comprises a mast pivot actuator 80. The mast pivot actuator 80 is adapted to pivot the first mast 10 and the second mast 30 away from each other when the guide system 60 is in the disconnected state.

In the embodiment of FIG. 1, the mast pivot actuator 80 comprises a push-off-and-hold device 81. The push-off-and-hold device 81 has an active state and an inactive state. In the active state, push-off-and-hold device 81 is connected to both the first mast 10 and the second mast 30. In the inactive state, push-off-and-hold device 81 is disconnected from at least one of the first mast 10 and the second mast 30. This embodiment allows a controlled pivoting of the second mast 30 relative to the first mast 10 after the guide system 60 has been brought into the disconnected state, at least during a first portion of the pivoting movement.

FIG. 2-FIG. 18 show subsequent steps of a first possible embodiment of a method for assembling a crane according to the invention.

Figure 2:
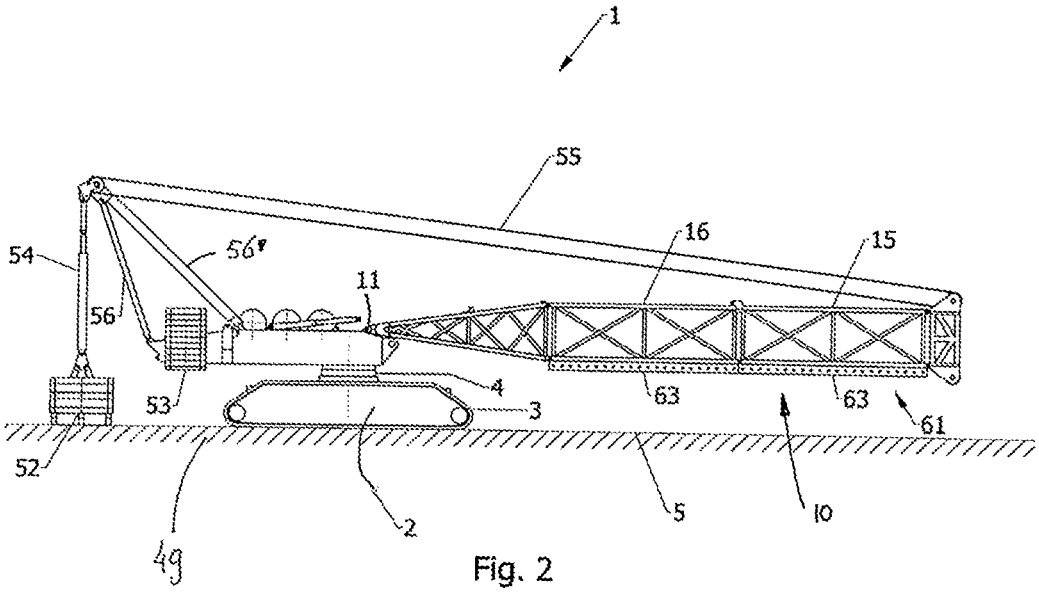
FIG. 2-18: subsequent steps of a first embodiment of a method for assembling a crane according to the invention.

FIG. 2 shows a first step in a possible embodiment of the method according to the invention. A crane base 2 is arranged on the ground 5. The crane base 2 comprises two tracks 3 (one of which is shown in FIG. 2) and a slewing ring 4.

The first mast 10 is connected to the first pivot 11 on the crane base 2. The first mast 10 at this stage comprises a top mast section 15 and a first subsequent mast section 16. In this stage, the first mast 10 for example extends in a substantially horizontal position.

A first guide device 61 is connected to an exterior surface of the first mast 10. The first guide device 61 comprises guide rails 63 which are mounted to the top mast section 15 and the first subsequent mast section 16. The guide rails 63 extend in line which each other. In this embodiment, each mast section 15, 16 of the first mast 10 is provided with two guide rails 63, which extend in longitudinal direction of the mast section 15, 16 and are arranged spaced apart from each other (see e.g. FIG. 3).

In this stage, the first mast 10 is also connected to the first mast fixing means. The first mast fixing means comprise fixing rods 51 (see FIG. 3), which extend between the first mast 10 and the crane base 2. In the embodiment shown, the fixing rods 51 are not connected to the first mast 10 yet in the step of FIG. 2. In this embodiment, the fixing rods 51 comprise hydraulic cylinders. In this embodiment, the first mast fixing device further comprises a first ballast 52 and a second ballast 53. First ballast 52 is arranged on the ground 49 at a distance from the crane base 2 and is connected to the top of the first mast 10 via connection elements 54, 55. Connection element 54 may for example comprise one or more cables, tubes, beams and/or hydraulic cylinders. The second ballast 53 is mounted on the crane base 2, and is connected to the top of the first mast 10 via connection elements 55, 56, 56'. Connection element 55 may for example comprise one or more cables, tubes, beams and/or hydraulic cylinders. The first ballast 52 and/or the second ballast 52 may be used as ballasts during the operation of the crane 1 as well. If desired, the first ballast 53 may be arranged at a different position during the operation of the crane 1 than during assembly and/or disassembly of the crane 1.

Figure 3:
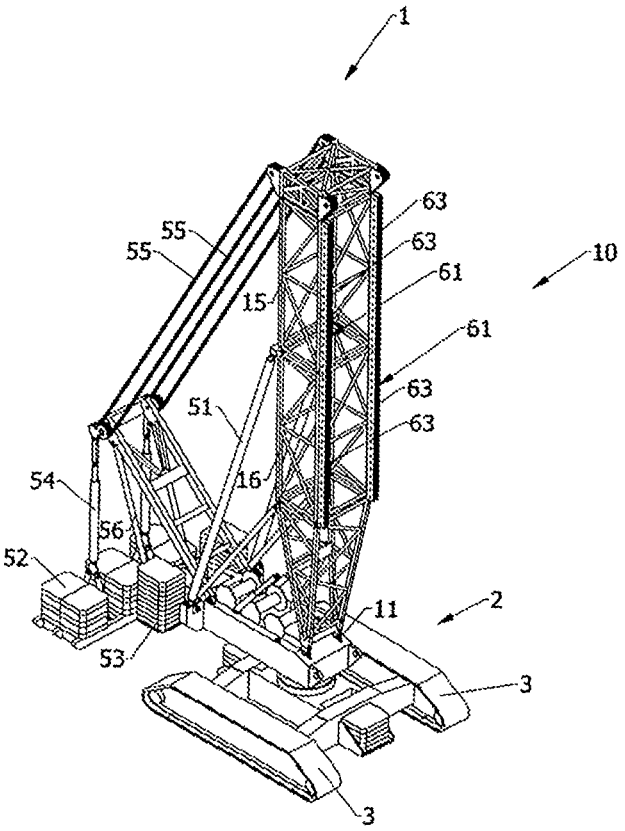

FIG. 3 shows a subsequent step in a possible embodiment of the assembly of the crane 1 according to the invention. In this step, the first mast 10 is brought into a vertical position relative to the crane base 2, for example by an auxiliary crane and/or by winches (e.g. own winches of the crane 1).

After the first mast 10 is brought into a vertical position relative to the crane base 2, the first mast 10 is fixed relative to the crane base 2 in a vertical position by the first mast fixing device. The fixing rods 51 are now connected to the first mast 10.

Figure 4A:
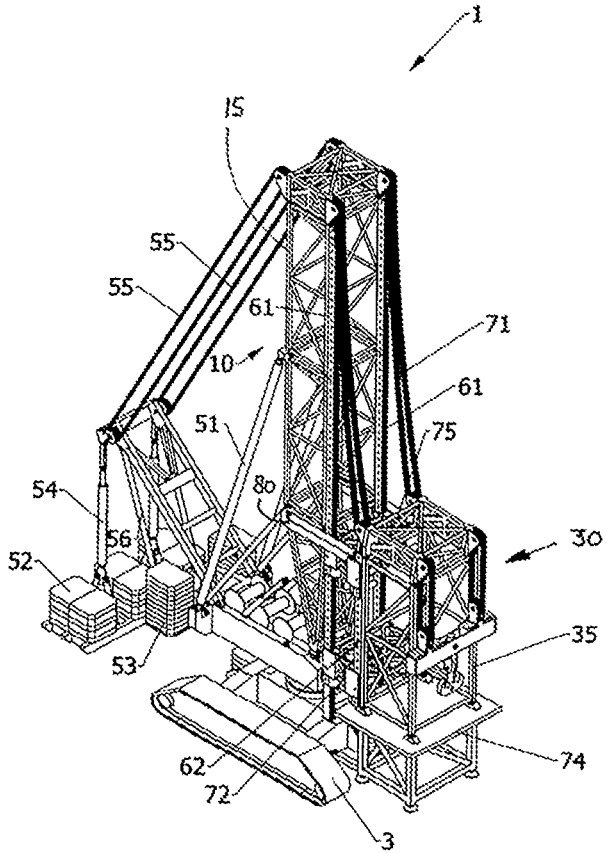
Figure 4B:
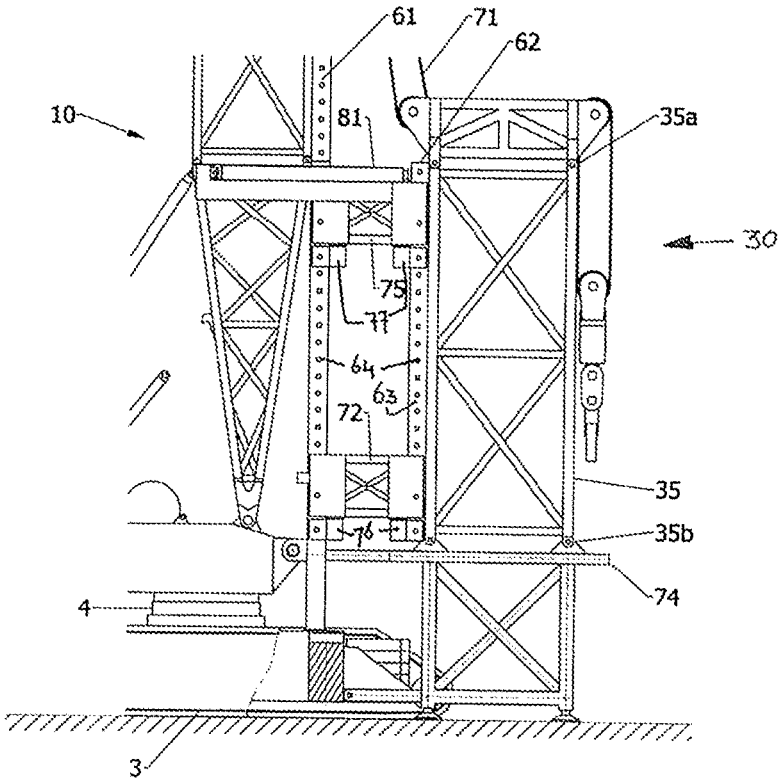

FIG. 4A and FIG. 4B show a subsequent step in a possible embodiment of the assembly of the crane 1 according to the invention. FIG. 4A shows this step in isometric view, while FIG. 4B shows a part of the crane 1 in this step in a side view.

In this stage, a mounting platform 74 is arranged adjacent to the crane base 2. Optionally, the mounting platform is fixed to the crane base 2. Furthermore, the mast section locking device 75 is mounted to the first mast 10, as well as first carriage 72 of the mast section mounting device.

The mast section locking device 75 and the first carriage 72 connect the first guide device 61 and the second guide device 62 with each other, thereby bringing the guide system into the connected state.

Furthermore, the push-off-and-hold-device 81 of the mast pivot actuator 80 is mounted onto the first mast 10.

In this step, a top mast section 35 of the second mast 30—which top mast section 35 is provided with at least a part of the second guide device 62—is arranged adjacent to and outside of the first mast 10 at a first position, which is in this embodiment on the mounting table 74. This first position at a vertical distance from the crane base 2, e.g. measured from the top of the slewing ring 4. The top mast section 35 of the second mast 30 will form the top portion of the second mast 30 in the assembled crane 1. In this embodiment, the top mast section 35 is provided with sheaves and/or cables already when it is arranged in the first position. The top mast section has an upper end 35*a* and a lower end 35*b*, and a longitudinal axis.

The top mast section 35 of the second mast 30 is connected to the top mast section 15 of the first mast by cables 71. These cables 71 can be used as guy wires between the top of the first mast 10 and the top of the second mast 30. In this stage of the method, these cables 71 do not have to be taut.

In the embodiment shown, the first carriage 72 of the mast section mounting device is provided with hydraulic jacks 76. In addition, the mast section locking device 75 is also provided with hydraulic jacks 77.

In the embodiment shown, the guide rails 63 have holes 64, in which a pin can be arranged. To move the first carriage 72 up or down along the guide rails 63, first a first pin is arranged in one of the holes 64. Then, the hydraulic jack 76 is extended, thereby moving the first carriage 72 upwards along the guide rail 63 to a higher position. Then, the first carriage is fixed to the guide rail in this higher position (e.g. by arranging a second pin in a hole 64 higher up along the guide rail 63), and the first pin is removed from the hole 64. Then, the hydraulic jack is retracted (so, the jack becomes shorter again), and the first pin is arranged in a subsequent hole 64 of the guide rail. This way, the first carriage 72 can climb in the masts 10, 30 along the guide rails 63. The first carriage 72 can descend again by using the hydraulic jacks 76 in the reverse way. This arrangement can also be used to fix the position of the first carriage 72 relative to the first mast 10 and/or to the second mast 30.

The mast section locking device 75 can move up and down along the guide rails 63 in the same way as the first carriage 72. The pins and holes 64, optionally in combination with the hydraulic jacks 77, can be used to fix the position of the mast section locking device 75 relative to the first mast 10 and/or to the second mast 30.

Figure 5:
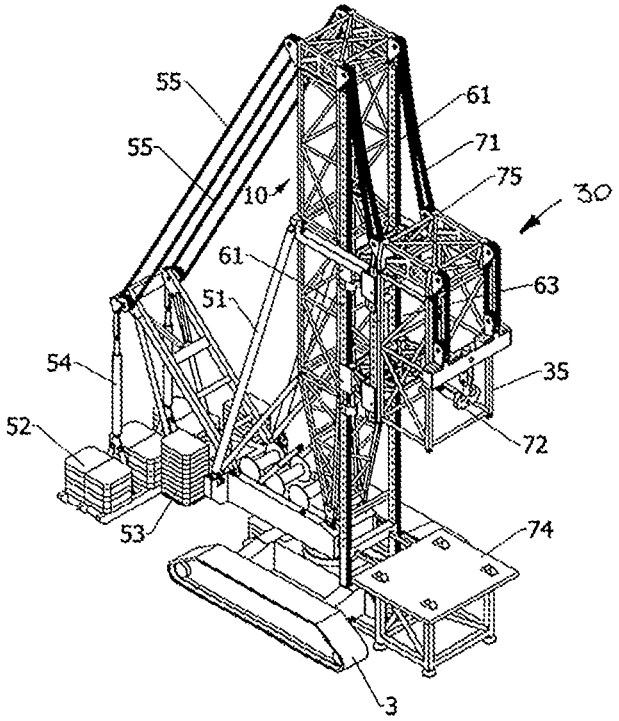

FIG. 5 shows a subsequent step in a possible embodiment of the assembly of the crane 1 according to the invention.

In this step, the top mast section 35 of the second mast 30 is moved vertically upwards by the mast section mounting device. The first carriage 72 and the mast section locking device 75 hold the top mast section 35 of the second mast 30. The first carriage 72 and the mast section locking device 75 are moved upwards along the first guide device 61 and the top mast section of the second mast 30 moves along with them. This movement is guided by the guide system.

The first carriage 72 and the mast section locking device 75 can be moved upwards by a puling action of one or more cables and/or by a pushing action or pulling action of one or more hydraulic jacks.

Then, the top mast section 35 of the second mast 30 is fixed relative to first mast 10 at a second position, which is the position shown in FIG. 5. The fixing is carried out by the mast section locking device 75. The second position is at a larger vertical distance from the crane base 2 than the first position.

Figure 6:
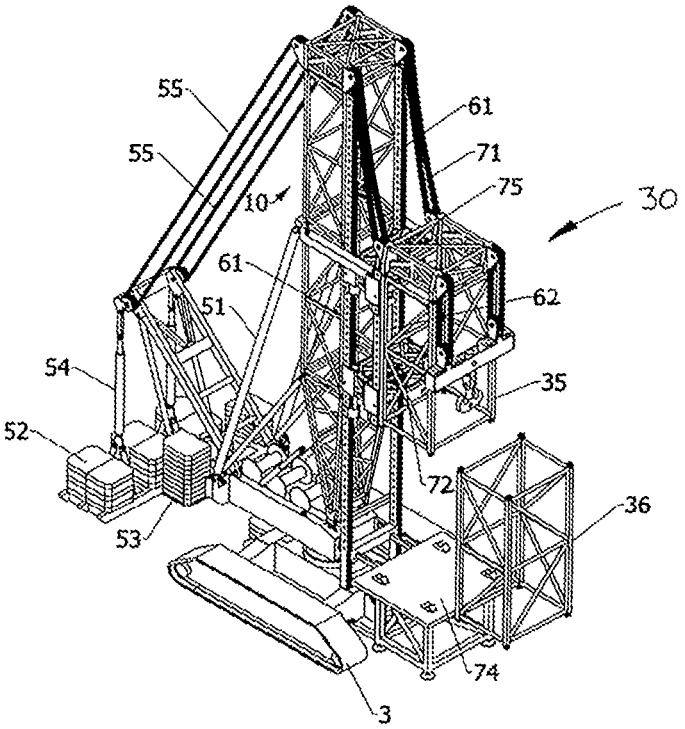

FIG. 6 shows a subsequent step in a possible embodiment of the assembly of the crane 1 according to the invention.

In this step, a first intermediate mast section 36 of the second mast 30 is provided and subsequently arranged on the mounting table 74.

Figure 7:
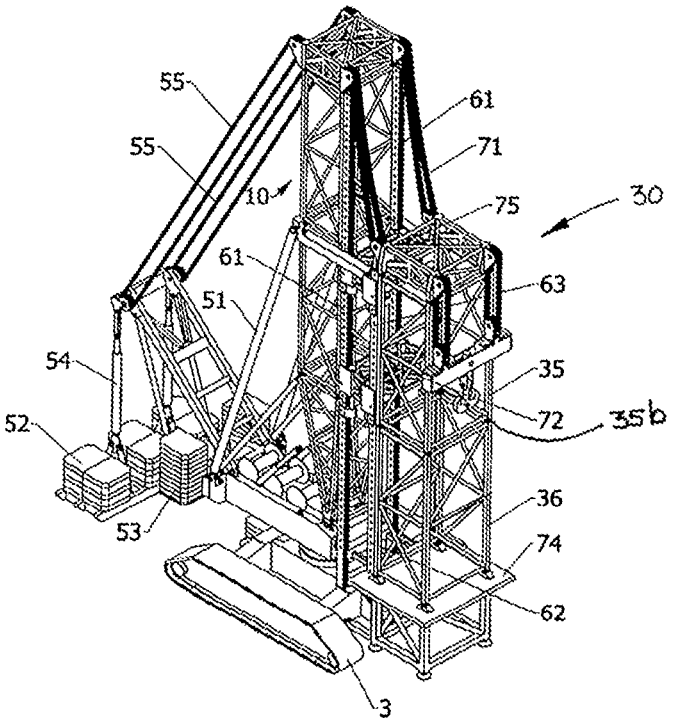

FIG. 7 shows a subsequent step in in a possible embodiment of the assembly of the crane 1 according to the invention.

In this step, the first intermediate mast section 36 of the second mast 30 is fixed to the lower end 35*b* of the top mast section 35 of the second mast 30. When the second mast 30 will be fully assembled, the second mast will comprise the top mast section 35 and at least one intermediate mast section 36, 36*. In general, the fully assembled second mast 30 will comprise a top mast section 35 and a plurality of intermediate mast sections 36, 36*.

The first intermediate mast section 36 comprises two guide rails 63. When the first intermediate mast section 36 of the second mast 30 is fixed to the lower end 35*b* of the top mast section 35 of the second mast 30, these guide rails 63 extend in line with the guide rails 63 of the top mast section 35 of the second mast 30. The guide rails 63 of the mast sections 35, 36, 36* together form part of the second guide device 62.

Figure 8:
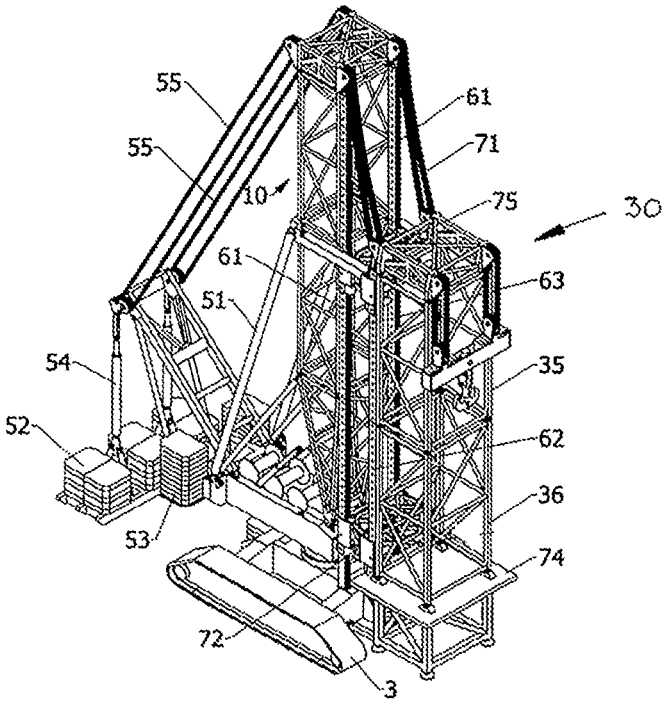

FIG. 8 shows a subsequent step in a possible embodiment of the assembly of the crane 1 according to the invention.

In this step, the first carriage 72 of the mast section mounting device is moved downwards along the first guide device 61 towards the mounting table 74. When it has reached the position of shown in FIG. 8, the first carriage 72 is connected to the first intermediate mast section 36 of the second mast 30.

The mast section locking device 75 subsequently releases the fixation of the top mast section 35 of the second mast 30 to the first mast 10 in vertical direction. The guide system remains in its connected state, and the mast section locking device 75 remains connected to the top mast section 35 of the second mast 30.

Figure 9:
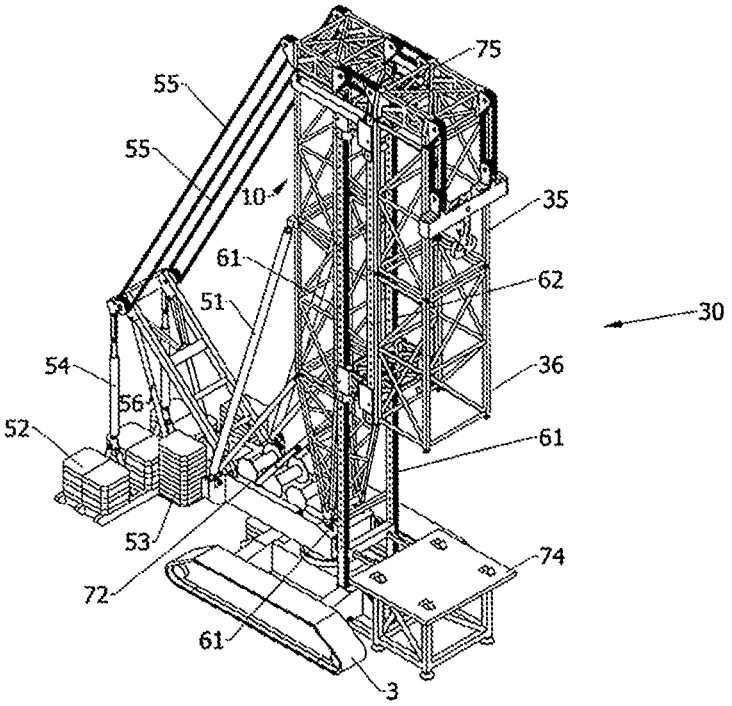

FIG. 9 shows a subsequent step in a possible embodiment of the assembly of the crane 1 according to the invention.

In this step, the mast section mounting device moves the top mast section 35 and the first intermediate mast section 36 of the second mast 30 jointly vertically upwards by moving the first carriage 72 upwards along the guide rails of the first guide device 61 and the second guide device 62. This movement is therewith guided by the guide system. By this upwards movement, the top mast section 35 of the second mast 30 is brought into a third position which is at a larger vertical distance from the crane base 2 than the second position.

Then, the top mast section 35 and the first intermediate mast section 36 of the second mast 30 are fixed relative to the first mast by the mast section locking device 75.

Figure 10:
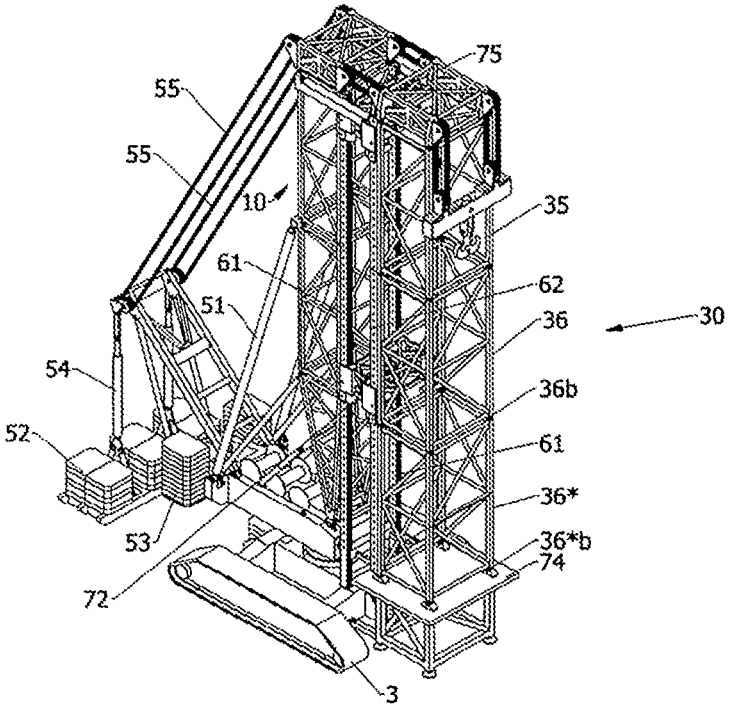

FIG. 10 shows a subsequent step in a possible embodiment of the assembly of the crane 1 according to the invention.

In this step, a subsequent intermediate mast section 36* of the second mast 30 is connected to a lower end 36*b* of the first intermediate mast section 36 of the second mast 30 to further build up the second mast.

By repeating the steps of connecting a subsequent intermediate mast section 36* of the second mast 30 is connected to a lower end 36*b*, 36**b* of the until then lowermost intermediate mast section 36, 36*, releasing the fixing in vertical direction by the mast section locking device, jointly moving the tops mast section 35 and all intermediate mast sections 36, 36* upwards by the first carriage 72 which engages the lowermost intermediate mast section and re-establishing the fixing in vertical direction of the joint top mast section 35 and intermediate mast sections 36, 36* by the mast section locking device, the second mast 30 can be elongated to the desired length.

So, in this embodiment at least the following additional steps are carried out:

releasing the fixation of the top mast section 35, first intermediate mast section 36 and subsequent intermediate mast section 36*of the second mast 30 to the first mast 10, and jointly moving the top mast section 35, the first intermediate mast section 36 and subsequent intermediate mast section 36* of the second mast 30 vertically upwards, which movement is guided by the guide system 60, thereby bringing the top mast section 35 of the second mast 30 into a fourth position which is at a larger vertical distance from the crane base 2 than the third position, fixing the top mast section 35, the first intermediate mast section 36 and the subsequent intermediate mast section 36* of the second mast 30 relative to the first mast 10 by the mast section locking device 75, connecting a further subsequent intermediate mast section of the second mast 30 to a lower end 36**b* of the subsequent intermediate mast section 36* of the second mast to further build up the second mast 30.

By repeating these steps, and every time fixing the top mast section 35 at a position further away from the crane base 2, the second mast 30 can be assembled to the desired length.

Figure 11:
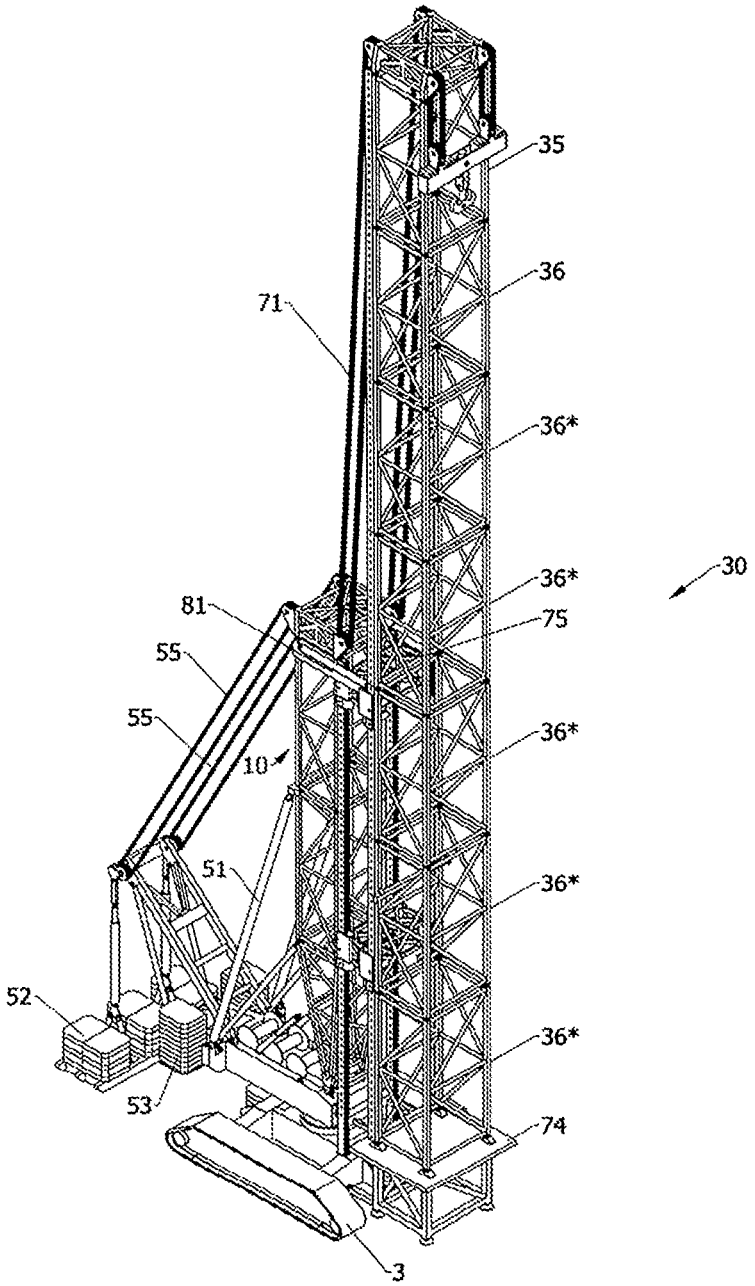

This results in the situation of FIG. 11.

As can be seen in FIG. 11, the second mast 30 can be made longer than the first mast 10. This can be achieved because the first carriage 72 continues to engage the lowermost intermediate section 36, 36* of the second mast 30 when it moves the joint top mast section 35 and intermediate sections 36, 36* upwards.

The mast section locking device 75 continues to lock and release the joint top mast section 35 and intermediate sections 36, 36*. However, when the length of the second mast 30 starts to exceed the length of the first mast 10, the mast section locking device 75 no longer engages the top mast section 35 of the second mast directly, but via one or more intermediate mast sections 36, 36*. The mast section locking device 75 in this situation engages one of the intermediate mast sections 36, 36* directly (e.g. via the second guide device 62).

Figure 12:
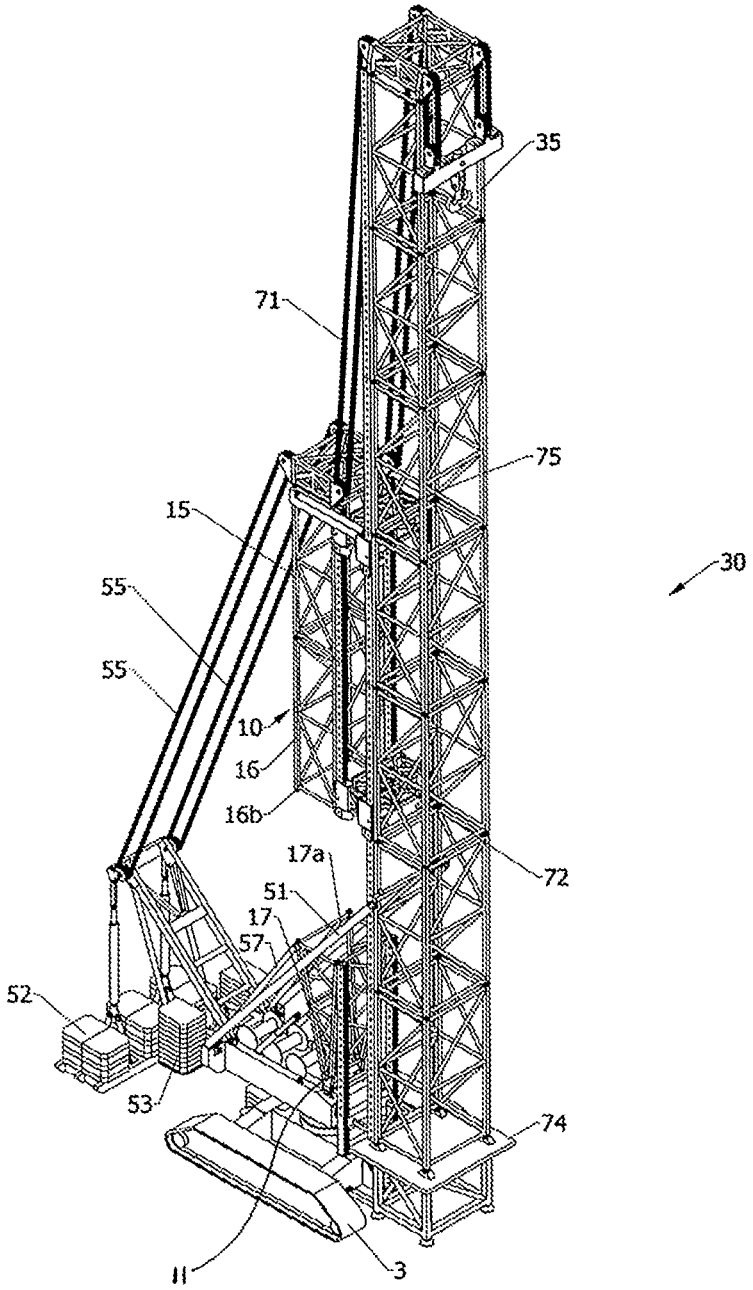

In this shown embodiment of the method according to the invention, it is now desired to further elongate the first mast 10. FIG. 12 shows a subsequent step in this possible embodiment of the assembly of the crane 1 according to the invention.

In order to achieve this, the second mast 30 is fixed relative to the crane base 2 in a vertical position. In the shown embodiment, this fixing is established by fixing rods 51 which were before used to fix the first mast in vertical position. However, alternatively a dedicated mast fixing device can be provided for fixing the second mast 30 relative to the crane base 2 in a vertical position.

Then, a lower end 16*b* of a first mast section of the first mast 10 is disconnected from the first pivot 11. Optionally, this involves releasing the fixation of the first mast 10 relative to the crane base 2. In this embodiment, this first mast section is the combination of intermediate mast section 16 of the first mast 10 and the top mast section 15 of the first mast 10. In other embodiments, the first mast section can be for example only the top mast section 15 of the first mast, or a combination of the top mast section 15 of the first mast 10 and multiple intermediate mast sections 16 of the first mast 10.

A connection mast section 17, which in the fully assembled crane connects the first mast 10 to the first pivot 11, remains in the position it was in before the first mast section disconnected form the first pivot 11. The connection mast section 17 is for example held in place by connection rod 57 of the first mast fixing device.

Then, the first mast section of the first mast 10 is moved vertically upwards by the mast section mounting device. is moved vertically upwards by the mast section mounting device. The first carriage 72 and the mast section locking device 75 hold the first mast section 35 of the first mast 10. The first carriage 72 and the mast section locking device 75 are moved upwards along the second guide device 62 and the first mast section of the first mast 10 moves along with them. This movement is guided by the guide system.

The first carriage 72 and the mast section locking device 75 can be moved upwards by a puling action of one or more cables and/or by a pushing action or pulling action of one or more hydraulic jacks 76, 77.

Then, the first mast section of the first mast 10 is fixed relative to second mast 30 at a second position, which is the position shown in FIG. 12 The fixing is carried out by the mast section locking device 75. The second position is at a larger vertical distance from the crane base 2 than the position it was in when the first mast section was still fixed to the upper end 17*a* of the connection mast section 17.

Figure 13:
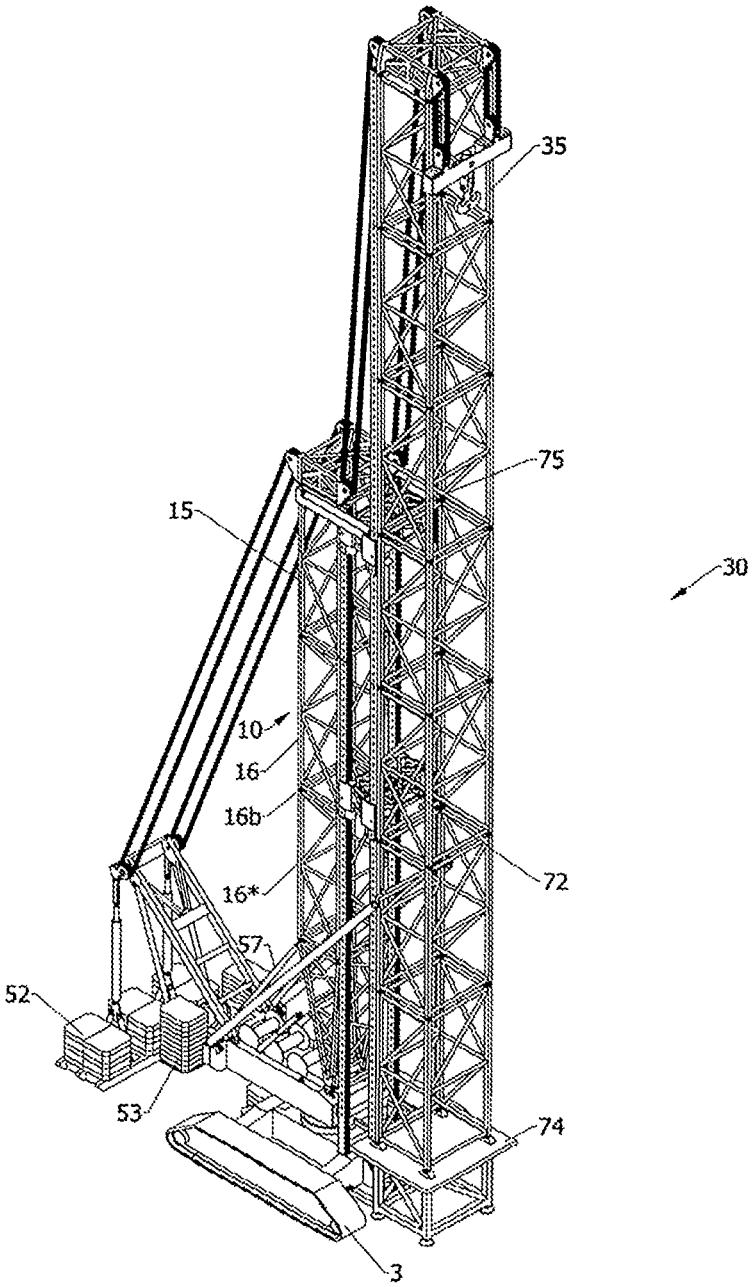

FIG. 13 shows a subsequent step in a possible embodiment of the assembly of the crane 1 according to the invention.

In this step, a first intermediate mast section 16* of the first mast 10 is inserted in the space between the upper end 17*a* of the connection mast section 17 and the lower end 16*b* of the first mast section of the first mast 10. Then, the intermediate mast section 16* of the first mast 10 is fixed to the lower end 16*b* of the first mast section of the first mast 10 to further build up the first mast 10.

Optionally, in this embodiment, one or more subsequent intermediate mast sections 16* are subsequently added to the first mast 10. Each subsequent intermediate mast section 16* is connected to the lower end of the (until then) lowest intermediate mast section 16, 16* of the first mast 10. This way, the first mast can be extended to its desired length.

During this adding, the first carriage 72 moves the connected top mast section 15 and intermediate mast sections 16, 16* of the first mast 10 upwards, in the same way as the first carriage 72 did with the joint mast sections 35, 36, 36* of the second mast 30. Likewise, the mast section locking device 75 locks the connected top mast section 15 and intermediate mast sections 16, 16* of the first mast 10 in the vertical direction relative to the second mast 30 as it did with the joint mast sections 35, 36, 36* of the second mast 30 relative to the first mast 10.

This embodiment allows the extend the length of the first mast after the second mast has been fully or partially assembled.

Figure 14:
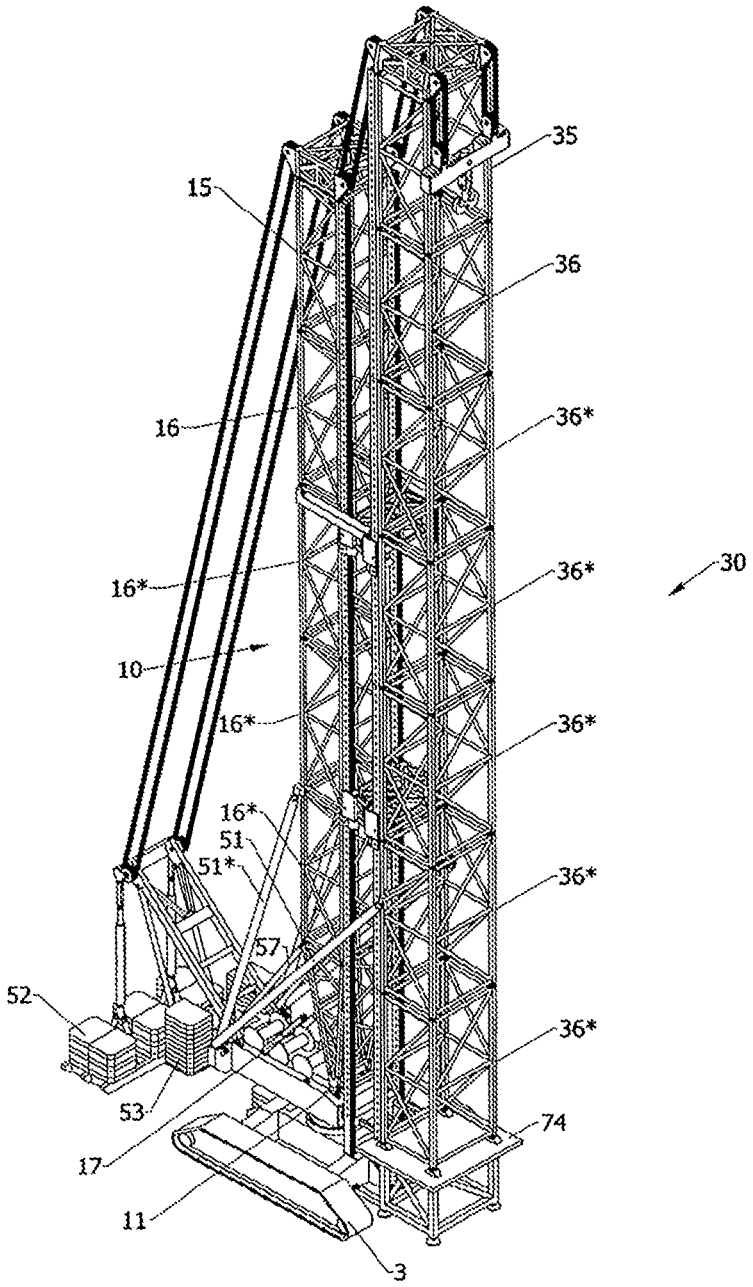

FIG. 14 shows the stage of the method in which the first mast 10 and the second mast 30 have the desired number intermediate mast sections 16, 16*, 36, 36*.

Then, the lowermost intermediate mast section 16* of the first mast is then fixed to the connection mast section 17. Furthermore, a further fixing rod 51* is arranged to fix the first mast 10 in a vertical position relative the crane base 2.

Figure 15:
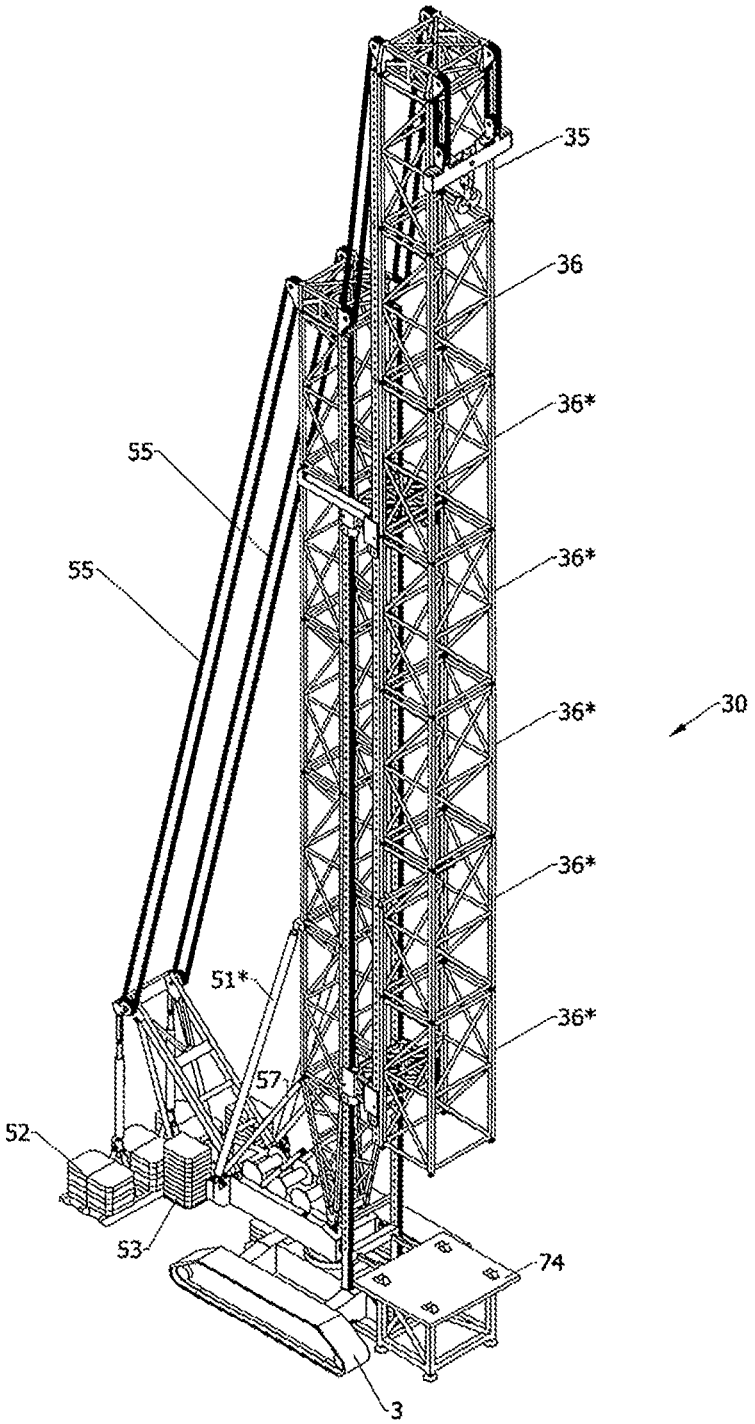

FIG. 15 shows a subsequent step in a possible embodiment of the assembly of the crane 1 according to the invention.

Now, the first mast 10 is fixed again in a vertical position relative to the crane base 2. The fixing of the second mast 30 relative to the crane base 2 has been released. The mast section mounting device moves the joint mast sections 35, 36, 36* of the second mast 30 upwards again, and then the mast section locking device locks the joint mast sections 35, 36, 36* of the second mast 30 in a vertical position relative to the first mast 10. This way, some space is created between the lower end of the lowermost intermediate mast section 36* of the second mast 30 and the crane base 2.

As a subsequent step, the mounting table 74 is removed, and a connection mast section 37 (see FIG. 16B) is arranged between the second pivot 31 and the lower end of the lowermost intermediate mast section 36* of the second mast 30. A first end 37*a* of the connection mast section 37 is connected to the lower end of the first intermediate mast section 36 of the second mast, in this embodiment in an indirect way via the subsequent mast sections 36*. Furthermore, a second end 37*b* of the connection mast section 37 is connected to the second pivot 31. This is shown in FIG. 16A.

Figure 16A:
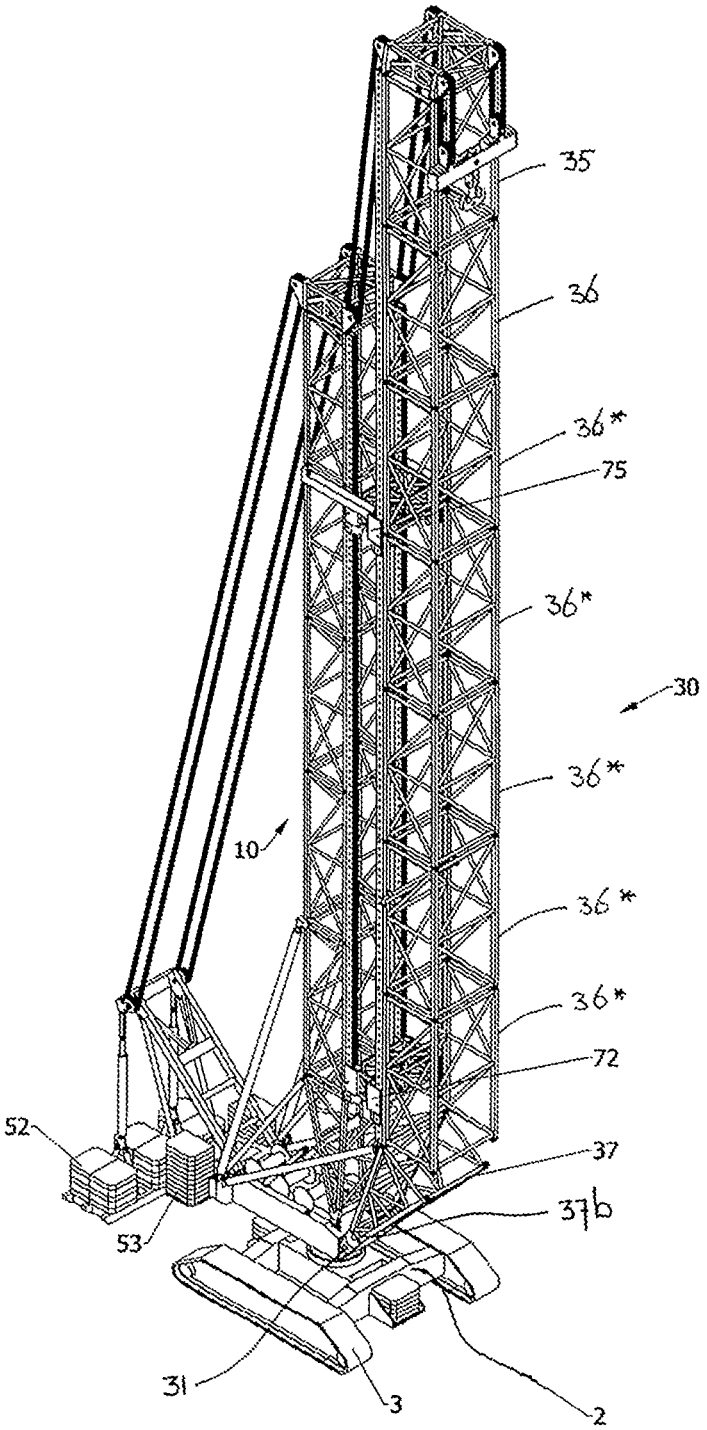
Figure 16B:
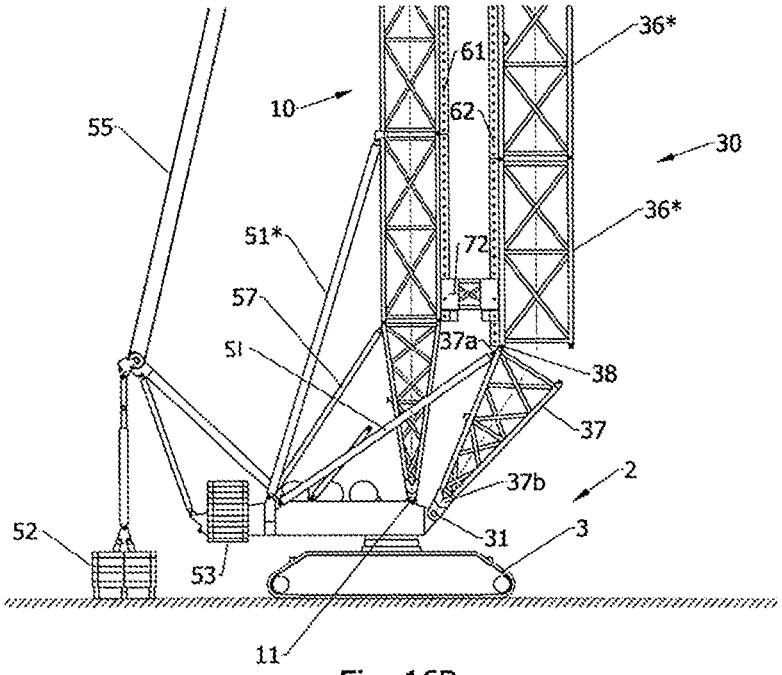

FIG. 16B shows the lower part of the crane in the situation of FIG. 16A in side view.

As can be seen in FIG. 16B, in this embodiment the connection mast section 37 has a longitudinal axis which extends at an angle relative to the vertical direction after the second end 37*b* of the connection mast section has been connected to the second pivot 31. The first end 37*a* of the connection mast section 37 is connected to the lower end of the first intermediate mast section 36 via a third pivot 38.

In this embodiment, then the first intermediate mast section 36, subsequent intermediate mast sections 36* and the top mast section 35 of the second mast 30 are pivoted jointly about the third pivot 38 to make that the first intermediate mast section 36, subsequent intermediate mast sections 36* and the top mast section 35 of the second mast 30 come to extend coaxially with the connection mast section 37.

In order to allow this pivoting, the guide system is brought into the disconnected state. In this embodiment, this is done by disconnecting the mast section locking device 75, the first carriage 72 and the second carriage 72 from the second mast 30. Alternatively, the mast section locking device 75, the first carriage 72 and the second carriage are disconnected from the first mast 10, or from both the first mast 10 and the second mast 30.

Figure 17:
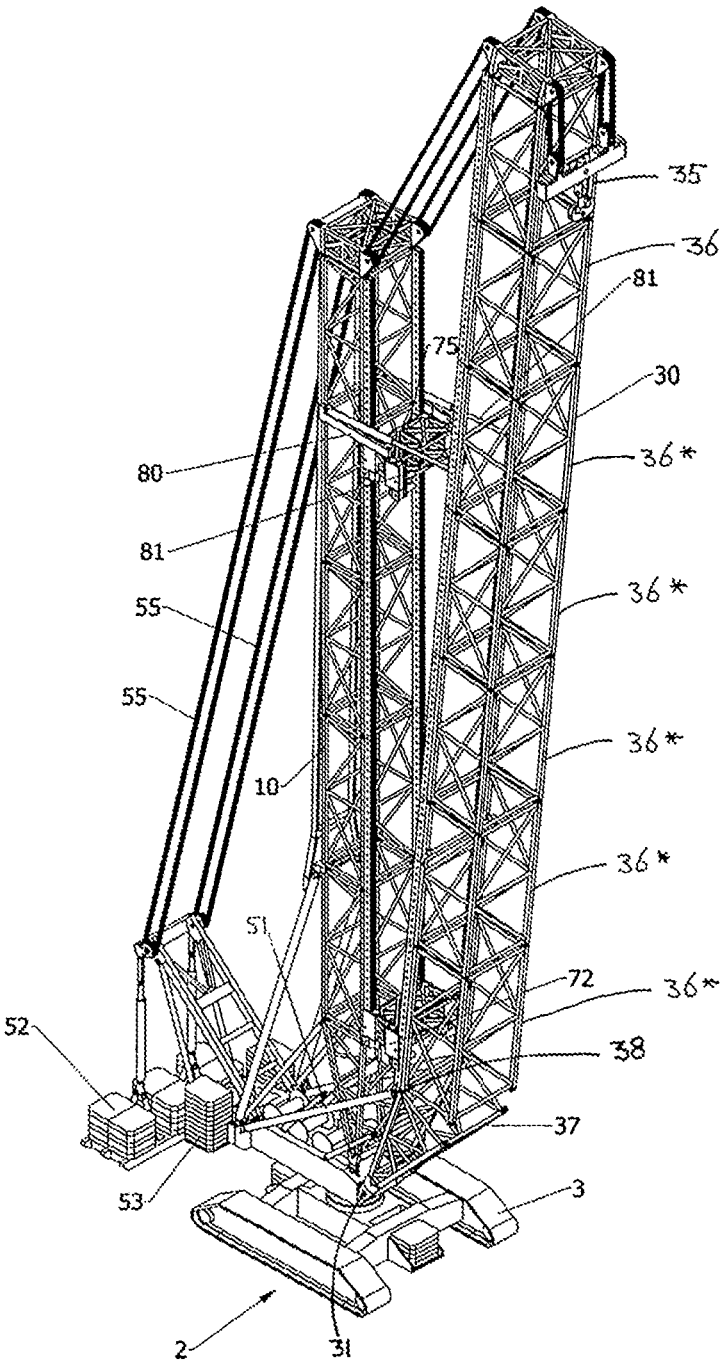

As can be seen in FIG. 17, the joint pivoting of the first intermediate mast section 36, subsequent intermediate mast sections 36* and the top mast section 35 is affected by the mast pivot actuator 80. In this embodiment, the mast pivot actuator comprises the mast pivot actuator 80 comprises a push-off-and-hold device 81. The push-off-and-hold device 81 has an active state and an inactive state. In the active state, push-off-and-hold device 81 is connected to both the first mast 10 and the second mast 30. In the inactive state, push-off-and-hold device 81 is disconnected from at least one of the first mast 10 and the second mast 30.

In the embodiment shown in FIG. 2 to FIG. 18, the push-off-and-hold device 81 comprises at least one hydraulic cylinder.

In the this embodiment of the method according to the invention, in this step the second mast 30 is pivoted away from the first mast 10 over a first opening angle by the mast pivot actuator. In this stage, the push-off-and-hold device 81 of the mast pivot actuator 80, is connected to both the first mast 10 and the second mast 30. This is shown in FIG. 17.

Then, the connection between the mast pivot actuator and the second mast 30 is released. The second mast 30 is then pivoted away from the first mast 10 over a further second opening angle under the influence of gravity and/or by the mast pivot actuator. This pivoting over the second opening angle is controlled by the guy wire 71.

When the first intermediate mast section 36, subsequent intermediate mast sections 36* and the top mast section 35 of the second mast 30 have been pivoted jointly about the third pivot 38 to the extent that the longitudinal axis of the first intermediate mast section 36, subsequent intermediate mast sections 36* and the top mast section 35 of the second mast 30 have become at least parallel to, but preferably coaxial with, the longitudinal axis of the connection mast section 37, the combination of first intermediate mast section 36, subsequent intermediate mast sections 36* and the top mast section 35 of the second mast 30 is rotationally fixed relative to the connection mast section 37 so they can no longer rotate about the third pivot 38.

Subsequently, the fixation of the first mast 10 relative to the crane base 2 by the first mast fixing device is released. So, the first mast 10 can pivot again about a horizontal axis relative to the crane base 2. Optionally, after this release of the fixing, the first mast 10 can also pivot about a vertical axis relative to the crane base 2.

Figure 18:
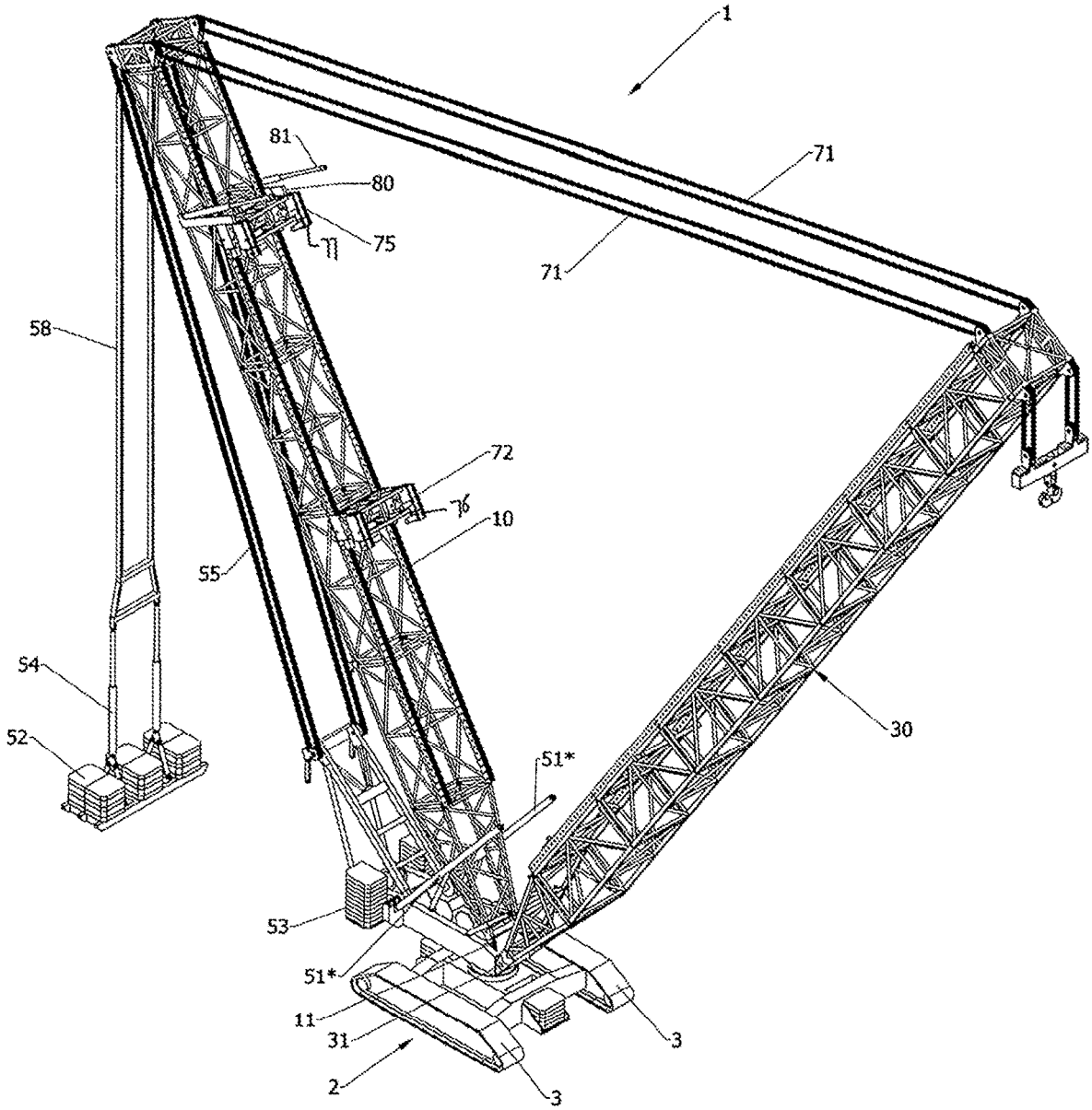

This situation is shown in FIG. 18. From the situation shown in FIG. 18, the crane 1 can be further prepared—if necessary—for hoisting operations. For example, the connection element 54 which was used during assembly of the crane 1 can be exchanged for or supplemented by operational connection element 58. In addition, the fixing rods 51* of the first mast fixing device may be removed if desired, and/or one or both of the ballasts 52, 53 may be moved to a different position and/or the weight of the ballast may be changed.

The disassembling of a crane 1 according to the invention can take place by generally carrying out the steps shown in FIG. 2—FIG. 18 in the reverse order.

Figure 19:
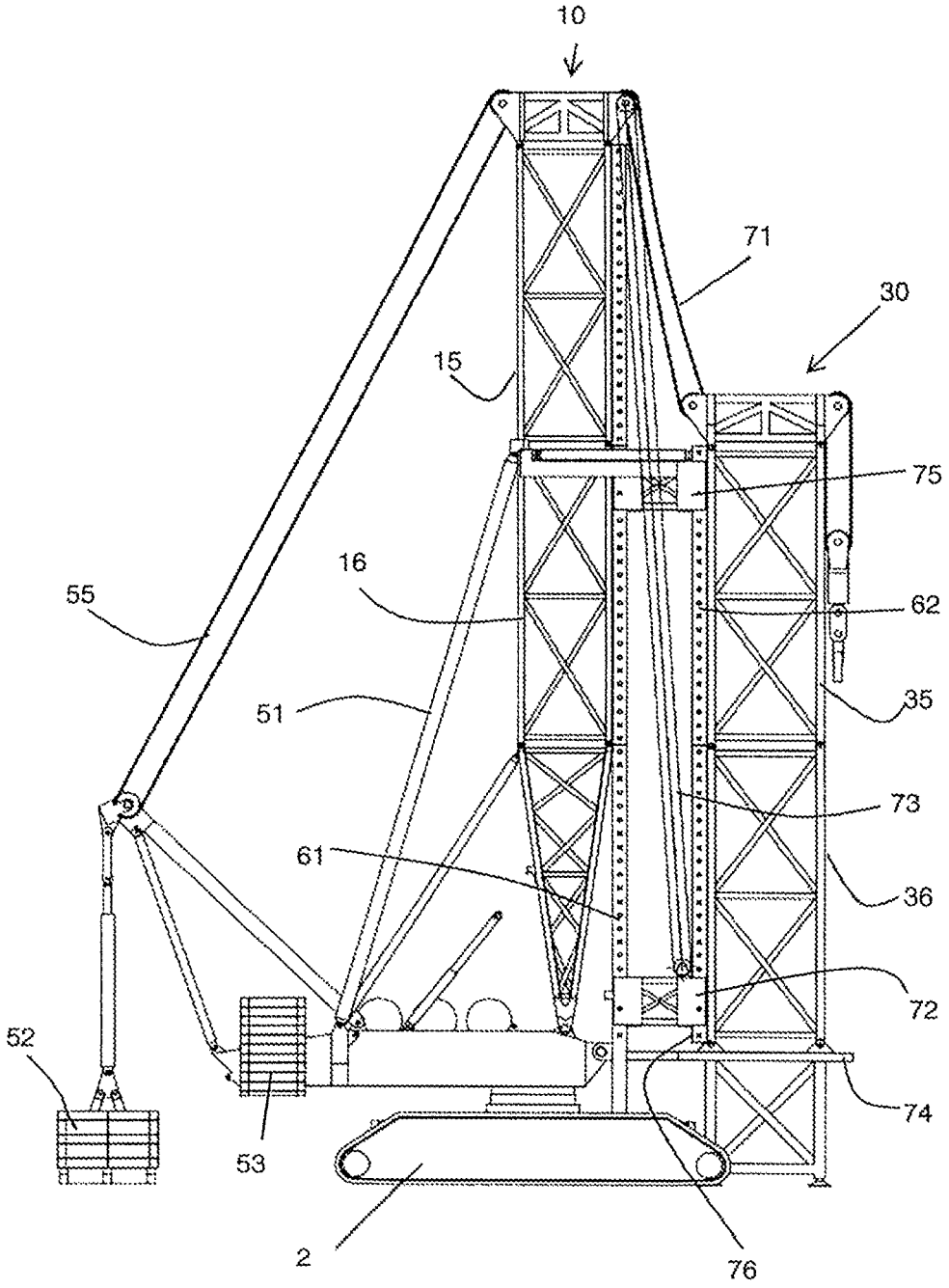
FIG. 19-20: a further embodiment of the invention.
Figure 20:
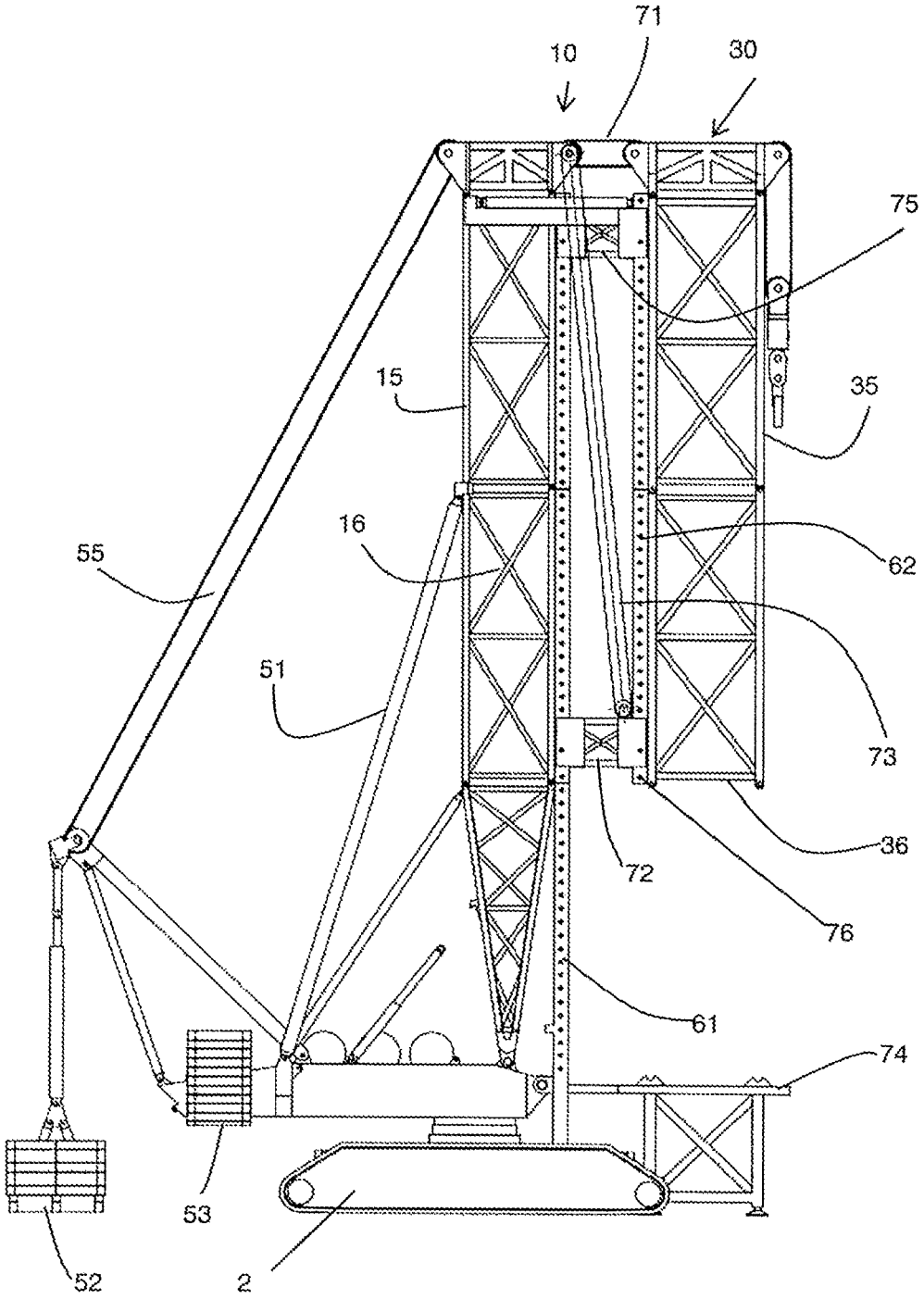

FIG. 19 and FIG. 20 show a further embodiment of the invention. In these FIGS. 19 and 20, identical reference numerals are used for the same or similar parts of the crane as in FIG. 1-18.

In this embodiment, the mast section mounting device comprises at least one cable 73 which is connected to the first carriage 72 of the mast section mounting device. This cable 73 is used to pull the first carriage 72 up along the first guide device 61 and second guide device 62 during the assembly of the crane. Optionally, in addition hydraulic jacks 76 are present to push the first carriage 72 up along the first guide device 61 and second guide device 62 during the assembly of the crane.

FIG. 19 shows this further embodiment during an assembly stage which is similar to the assembly stage shown in FIG. 8. The first carriage 72 of the mast section mounting device is connected to the lowermost intermediate mast section 36 of the second mast 30.

FIG. 20 shows this further embodiment during an assembly stage which is similar to the assembly stage shown in FIG. 9. The first carriage 72 of the mast section mounting device is connected to the lowermost intermediate mast section 36 of the second mast 30, and has moved the top mast section 35 and the first intermediate mast section 36 jointly upwards. This upward movement is obtained by a pulling action of cable 73. The cable 71 optionally remains slack before and/or during this pulling by cable 73.

Optionally, in this embodiment, cable 71 can be dispensed with. In that case, the first carriage 72 remains connected to the second mast 30, e.g. to the top mast section 35 of the second mast 30, when the guide system is in the disconnected state. The cable 73 then forms the guy wire between the first mast 10 and the second mast 30 in the assembled crane.

FIG. 21A-21E show an example of a possible method of assembling a mast section, which mast section is for example to form a top mast section or an intermediate mast section. This method can be used in combination with the crane and the method for assembling a crane in accordance with the invention, but also in combination with other cranes and crane assembly methods.

This method is optionally carried out at the same site as where the crane is assembled.

Figure 21A:
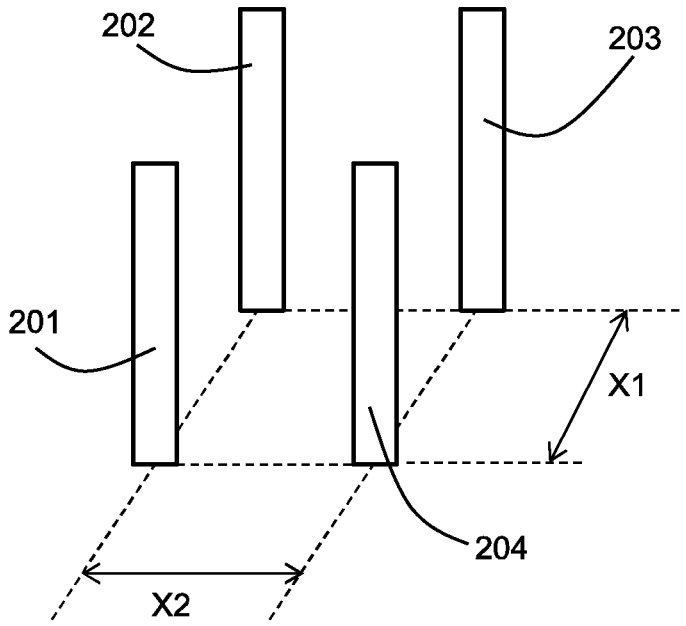
FIGS. 21A-E: an example of a possible method of assembling a mast section according to the invention.

FIG. 21A shows a first stage of this method of assembling a mast section.

A first corner tube 201 is fixed in a vertical position. A second corner tube 202 is also fixed in a vertical position. The second corner tube 202 is arranged at a first horizontal distance X1 from the first corner tube, This first horizontal distance X1 corresponds to the width of the mast section to be assembled in a first direction.

A third corner tube 203 is fixed in a vertical position, at a second horizontal distance X2 from the second corner tube. The second horizontal distance X2 corresponds to the width of the mast section to be assembled in a second direction which is perpendicular to the first direction.

A fourth corner tube 204 is fixed in a vertical position, at horizontal distance X1 in the first direction from the third corner tube 203 and at horizontal distance X2 in the second direction from the first corner tube 201.

Figure 21B:
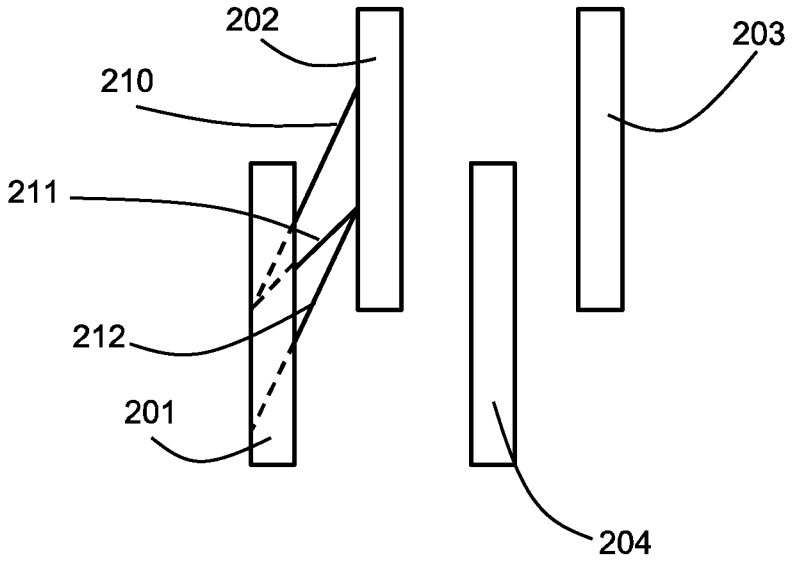

FIG. 21B shows a subsequent stage of this method of assembling a mast section.

In this stage, multiple connector tubes 210, 211, 212 are arranged between and connected to the first corner tube 201 and the second corner tube 202. As a result, the first corner tune 201 and the second corner tube 202 are connected to each other by the connector tubes 210, 211, 212.

Figure 21C:
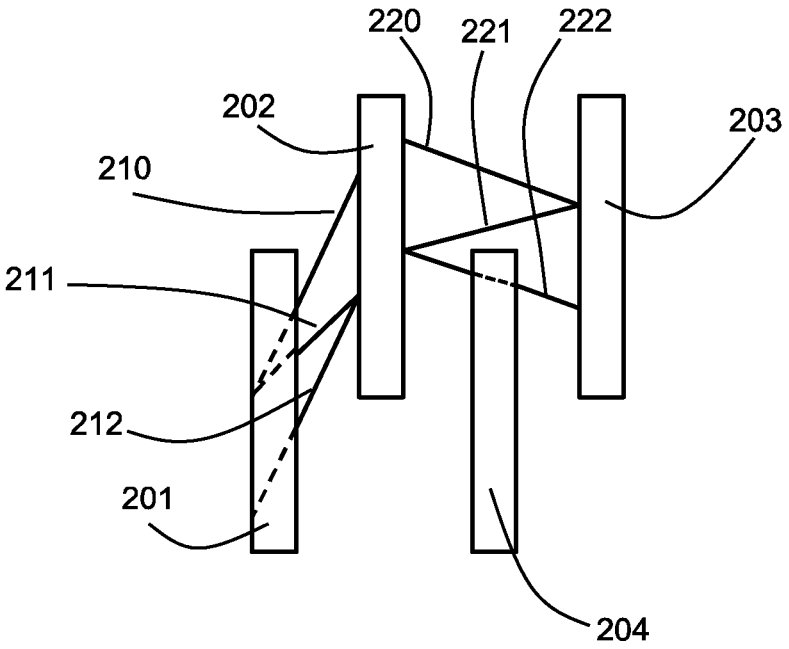

FIG. 21C shows a subsequent stage of this method of assembling a mast section.

In this stage, multiple connector tubes 220, 221, 222 are arranged between and connected to the second corner tube 202 and the third corner tube 203. As a result, the second corner tune 202 and the third corner tube 203 are connected to each other by the connector tubes 220, 221, 222.

Figure 21D:
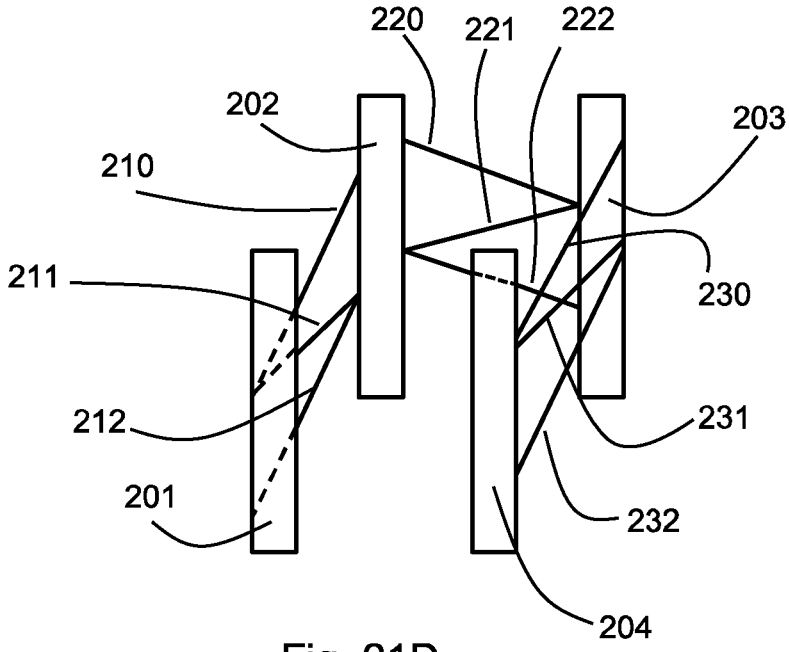

FIG. 21D shows a subsequent stage of this method of assembling a mast section.

In this stage, multiple connector tubes 230, 231, 232 are arranged between and connected to the third corner tube 203 and the fourth corner tube 204. As a result, the third corner tune 203 and the fourth corner tube 204 are connected to each other by the connector tubes 230, 231, 232.

Figure 21E:
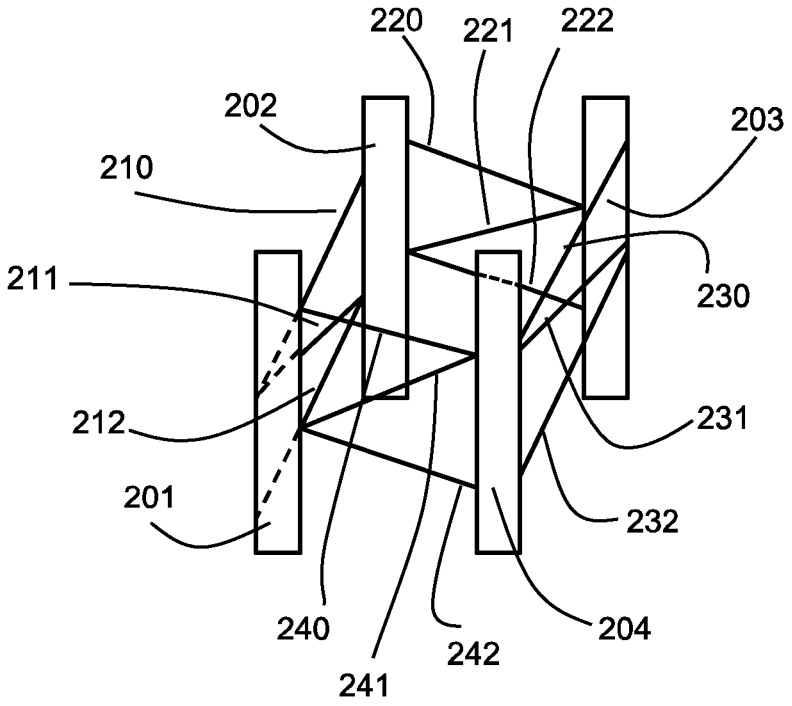

FIG. 21E shows a subsequent stage of this method of assembling a mast section.

In this stage, multiple connector tubes 240, 241, 242 are arranged between and connected to the fourth corner tube 204 and the first corner tube 201. As a result, the fourth corner tune 204 and the first corner tube 201 are connected to each other by the connector tubes 240, 241, 242.

The FIGS. 22A-F illustrate the assembly of a crane mast section according to the invention wherein use is made of a corner tubes support structure.

Figures 22A, 22B, 22C, 22D, 22E, 22F:
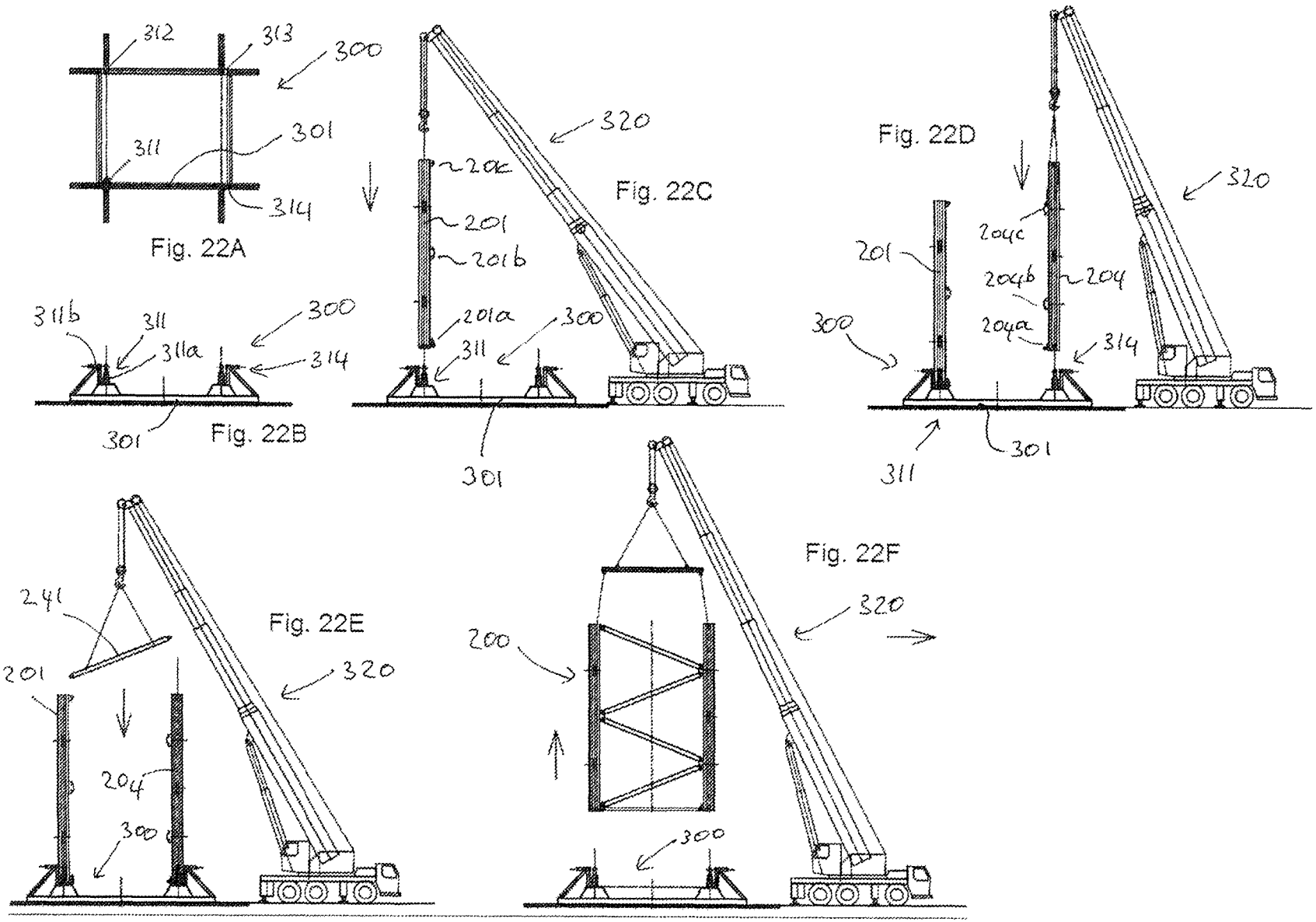
FIGS. 22A-F illustrate the assembly of a crane mast section according to the invention wherein use is made of a corner tubes support structure.

In FIGS. 22A, a top view, and 22B, a side view, an embodiment of a corner tubes support structure 300 is depicted for use in a crane mast section assembly method. The structure 300 has a base frame 301 that is embodied to be placed on the ground. As it is envisaged in this example that crane mast sections of rectangular cross-section are assembled, so with four corner tubes 201,202, 203, 204 in this example, the base frame 301 is provided with a first, second, third, and fourth corner tube fixing device, respectively 311,312,313, and 314 at locations corresponding to the widths of the mast section to be assembled in the first and second perpendicular directions. The base frame 301 is preferably embodiment such that the relative location of the fixing devices 311-314 is adjustable in order to allow use of the same base frame and fixing devices for the assembly of mast sections having different cross-sections.

In this example each corner tube fixing device 311,312, 313, and 314 comprises a stabbing member 311*a*, that is adapted enter into the lower end of respective corner tube.

Each corner tube fixing device 311, 312, 313, and 314 is adapted or configured to releasably fix a lower end of a respective corner tube that is positioned in vertical position on the base frame 301.

In this example each corner tube fixing device comprises a locking member and locking member actuator, e.g. a hydraulically actuable locking member 311*b*, e.g. a locking pin insertable into a locking hole provided in the lower end of the corner tube.

FIG. 22C illustrates the arranging a first corner tube 201 vertically on the corner tube support structure 300 so that a lower end thereof is fixed by said respective first corner tube fixing device 311. For example use is made of a mobile crane 320 to handle the corner tubes in this process.

FIG. 22D illustrates the arranging of the one or more further corner tubes, here corner tube 204, on the structure 300 so that all four corner tubes are then vertically arranged on the structure 300 and securely retained at their lower ends by the respective fixing device.

FIG. 22E illustrates the arrangement of all connector tubes that interconnect neighboring corner tubes to form the mast section. As can be seen here each of the corner tubes is prefabricated to have along the length thereof fastening members, e.g. plates 201*a,b,c* and 204*a,b,c* provided with one or more holes therein, adapted to secure thereto an end of a connector tube 241, e.g. the connector tubes having at axial ends thereof one or more plates provided with holes allowing to secure the respective end to the corner tube by means of a pin or bolt.

As illustrated, in a crane mast section, some of the connector tubes are arranged diagonally between two corner tubes whereas some of the connector tubes are arranged horizontally between two corner tubes.

Once the mast section 200 has been completed, the locking members of the fixing devices 311-314 are actuated to release the lower ends of the corner tubes and the entire mast section 200 can be removed from the structure 300, e.g. for further use in a method to assemble a crane or crane mast as described herein. The structure 300 can then be used for the assembly of yet another crane mast section.

The invention claimed is:

1. A Crane, which crane comprises:

a crane base;

a first mast, which is pivotable about a first pivot which is arranged at the crane base, the first pivot having a horizontal pivot axis, which first mast has a longitudinal axis, which first mast comprises a plurality of first mast sections, wherein the first mast is one of a back mast and a main boom;

a second mast, which is pivotable about a second pivot which is arranged at the crane base, the second pivot having a horizontal pivot axis, which second mast has a longitudinal axis, which second mast comprises a plurality of second mast sections, wherein the second mast is the other one of the back mast and the main boom, a first mast fixing device, which is adapted to releasably fix the first mast in a vertical position relative to the crane base;

a guide system, which comprises a first guide device connected to an exterior surface of the first mast and a second guide device which is connected to an exterior surface of the second mast, wherein the guide system has a connected state in which the longitudinal axis of the first mast and the longitudinal axis of the second mast both extend vertically and parallel to each other, and in which connected state the first guide device and the second guide device are movably connected to each other, the guide system being adapted to guide relative movement in vertical direction of at least the second mast section of the second mast which is connected to the second guide device and at least the first mast section of the first mast which is connected to the first guide device, and wherein the guide system further has a disconnected state in which the first guide device and the second guide device are disconnected from each other;

a mast section mounting device which is adapted to—during assembly of the crane—move at least the second mast section of the second mast which is connected to the guide system vertically upwards relative to at least the first mast section of the first mast while the guide system is in the connected state;

a mast section locking device, which is adapted to lock at least the second mast section of the second mast in a fixed position relative to at least the first mast section of the first mast when the guide system is in the connected state; and a mast pivot actuator, which is adapted to pivot the first mast and the second mast away from each other when the guide system is in the disconnected state.

2. The Crane according to claim 1, wherein the first mast is the back mast and the second mast is the main boom.

3. The Crane according to claim 1, wherein the first mast is the main boom and the second mast is the back mast.

4. The Crane according to claim 1, wherein the mast section mounting device comprises a hydraulic jack which is adapted to push at least one mast section of the second mast vertically upwards during assembly of the crane.

5. The Crane according to claim 1, wherein the mast section mounting device comprises a cable which is adapted to pull at least one mast section of the second mast vertically upwards during assembly of the crane, which cable in the assembled crane forms a guy wire between the first mast and the second mast.

6. The Crane according to claim 1, wherein the mast section mounting device comprises a carriage, which is moveable parallel to the longitudinal axis of the first mast, which carriage is adapted to engage the second mast section of the second mast when that second mast section is in a first position at a vertical distance from the crane base, to hold that second mast section during transfer of that second mast section from the first position to a second position which is at a different distance from the crane base than the first position, and to release that second mast section after that second mast section has been fixed in the second position.

7. The Crane according to claim 6, wherein the carriage is adapted to engage a lowest of the second mast sections of the second mast.

8. The Crane according to claim 1, wherein the mast section mounting device further is adapted to—during assembly of the crane—move at least the first mast section of the first mast which is connected to the guide system relative to at least the second mast section of the second mast vertically upwards when the guide system is in the connected state.

9. The Crane according to claim 1, wherein the mast pivot actuator comprises a push-off-and-hold device, which push-off-and-hold device has an active state and an inactive state, wherein in the active state, the push-off-and-hold device is connected to both the first mast and the second mast, and wherein in the inactive state, the push-off-and-hold device is disconnected from at least one of the first mast and the second mast.

10. A Method for assembling a crane, which method comprises the following steps:

connecting a first mast to a first pivot on a crane base, and subsequently fixing the first mast relative to the crane base in a vertical position by a first mast fixing device;

arranging a top mast section of a second mast—which top mast section is provided with at least a part of a second guide device—adjacent to and outside of the first mast at a first position which is at a vertical distance from the crane base, and connecting the at least part of the second guide device to a first guide device on the first mast, therewith bringing the guide system in the connected state;

moving the top mast section of the second mast vertically upwards by a mast section mounting device, this movement being guided by the guide system, and subsequently fixing the top mast section of the second mast relative to the first mast by a mast section locking device at a second position which is at a larger vertical distance from the crane base than the first position;

fixing a first intermediate mast section of the second mast to a lower end of the top mast section of the second mast to build up the second mast;

connecting the first intermediate mast section of the second mast to a second pivot on the crane base;

bringing the guide system in the disconnected state;

pivoting the second mast away from the first mast by a mast pivot actuator; and releasing the fixation of the first mast relative to the crane base by the first mast fixing device.

11. The Method according to claim 10, wherein after the step of fixing the first intermediate mast section of the second mast to the lower end of the top mast section of the second mast and before the step of connecting the first intermediate mast section to the second pivot on the crane base, the following additional steps are performed:

releasing the fixation of the top mast section of the second mast to the first mast, and jointly moving the top mast section and the first intermediate mast section of the second mast vertically upwards, which movement is guided by the guide system, thereby bringing the top mast section of the second mast into a third position which is at a larger vertical distance from the crane base than the second position;

fixing the top mast section and the first intermediate mast section of the second mast relative to the first mast by the mast section locking device; and connecting a subsequent intermediate mast section of the second mast to a lower end of the first intermediate mast section of the second mast to further build up the second mast, wherein the step of connecting the first intermediate mast section of the second mast to the second pivot on the crane base is realized by connecting the subsequent intermediate mast section to the second pivot on the crane base.

12. The Method according to claim 10, wherein the step of connecting the first intermediate mast section to a second pivot on the crane base comprises:

arranging a connection mast section between the lower end of the first intermediate mast section and the second pivot, and connecting a first end of the connection mast section to the lower end of the first intermediate mast section of the second mast and connecting a second end of the connection mast section to the second pivot.

13. The Method according to claim 12, wherein the connection mast section has a longitudinal axis which extends at an angle relative to the vertical direction after the second end of the connection mast section has been connected to the second pivot, and wherein the first end of the connection mast section is connected to the lower end of the first intermediate mast section via a third pivot, and wherein the first intermediate mast section and the top mast section of the second mast are pivoted jointly about the third pivot to make that the first intermediate mast section and the top mast section of the second mast comes to extend coaxially with the connection mast section, after which the first intermediate mast section is rotationally fixed relative to the connection mast section.

14. The Method according to claim 10, wherein the top mast section of the second mast is pulled upwards by a cable.

15. The Method according to claim 14, wherein the cable forms a guy wire between the first mast and the second mast after pivoting the second mast away from the first mast by the mast pivot actuator.

16. The Method according to claim 10, wherein the top mast section of the second mast is pushed upwards by a hydraulic jack.

17. The Method according to claim 10, wherein the second mast is pivoted away from the first mast by the following steps:

pivoting the second mast away from the first mast over a first opening angle by the mast pivot actuator, which mast pivot actuator is connected to both the first mast and the second mast, releasing the connection between the mast pivot actuator and the first mast and/or the second mast, pivoting the second mast away from the first mast over a further second opening angle under the influence of gravity.

18. The Method according to claim 10, wherein before bringing the guide system in the disconnected state, the following additional steps are performed:

fixing the second mast relative to the crane base in a vertical position, disconnecting a lower end of a first mast section of the first mast from the first pivot moving the first mast section of the first mast vertically upwards by the mast section mounting device, this movement being guided by the guide system, and subsequently fixing the first mast section of the first mast relative to second mast by the mast section locking device, fixing a first intermediate mast section of the first mast to a lower end of the first mast section of the first mast to further build up the first mast, connecting the first intermediate mast section of the first mast to the first pivot on the crane base.

19. The Method according to claim 10, wherein during at least a part of the assembly of the crane, the second mast is longer than the first mast.

20. A Method for disassembling a crane, which method comprises the following steps:

fixing a first mast in a vertical position relative to a crane base by a first mast fixing device, pivoting a second mast towards the first mast, bringing a guide system in the connected state, and fixing the second mast relative to the first mast in vertical direction with a top mast section of the second mast in a second position which is at a vertical distance from the crane base, disconnecting a first intermediate mast section of the second mast from a second pivot on the crane base, releasing the first intermediate mast section of the second mast from a lower end of a top mast section of the second mast, and removing the first intermediate mast section, releasing the fixation in vertical direction of the second mast relative to the first mast, and moving the top mast section of the second mast vertically downwards into a first position by a mast section mounting device, which first position is at a smaller vertical distance from the crane base than the second position, this movement being guided by the guide system, bringing the guide system into the disconnected state, removing a top mast section of the second mast, releasing the fixation of the first mast relative to the crane base, disconnecting the first mast from the first pivot on the crane base, and removing the first mast.

* * * * *